US012440078B2

(12) United States Patent
Kim et al.

(10) Patent No.: US 12,440,078 B2
(45) Date of Patent: Oct. 14, 2025

(54) CLEANING DEVICE AND CONTROL METHOD THEREOF

(71) Applicant: SAMSUNG ELECTRONICS CO., LTD., Suwon-si (KR)

(72) Inventors: Juhyuk Kim, Suwon-si (KR); Hyunkoo Kang, Suwon-si (KR); Seehyun Kim, Suwon-si (KR); Sanghyuk Park, Suwon-si (KR); Jinwook Yoon, Suwon-si (KR); Seongu Lee, Suwon-si (KR); Yeongju Lee, Suwon-si (KR); Jeonghee Cho, Suwon-si (KR); Sanghwa Choi, Suwon-si (KR); Jiwon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 351 days.

(21) Appl. No.: 18/196,138

(22) Filed: May 11, 2023

(65) Prior Publication Data

US 2023/0363602 A1 Nov. 16, 2023

Related U.S. Application Data

(63) Continuation of application No. PCT/KR2023/005360, filed on Apr. 20, 2023.

(30) Foreign Application Priority Data

May 13, 2022 (KR) ..... 10-2022-0059165
Sep. 19, 2022 (KR) ..... 10-2022-0118222

(51) Int. Cl.
*A47L 9/28* (2006.01)
*A46B 13/00* (2006.01)
(Continued)

(52) U.S. Cl.
CPC ..... *A47L 9/2842* (2013.01); *A46B 13/001* (2013.01); *A46B 13/02* (2013.01);
(Continued)

(58) Field of Classification Search
CPC .... A47L 9/2842; A47L 9/0063; A47L 9/0411; A47L 9/0477; A47L 9/2821;
(Continued)

(56) References Cited

U.S. PATENT DOCUMENTS 5,255,409 A * 10/1993 Fujiwara ..... A47L 9/2831 15/412
11,278,174 B2 * 3/2022 So ..... G05D 1/6485
(Continued)

FOREIGN PATENT DOCUMENTS

CN 109961455 A * 7/2019 ..... G01N 21/8806
CN 112417944 A * 2/2021 ..... G06F 18/23213
(Continued)

OTHER PUBLICATIONS

International Search Report dated Aug. 18, 2023 for International Application No. PCT/KR2023/005360.
(Continued)

*Primary Examiner* — Marc Carlson
(74) *Attorney, Agent, or Firm* — STAAS & HALSEY LLP

(57) ABSTRACT

A cleaning device including a suction motor; a suction head including a suction port; a rotatable brush inside the suction head; a brush motor; a pressure sensor; a memory storing coefficient tables including coefficients of a hyperplane equation for determining a type of surface to be cleaned; and a controller. The controller is configured to, in a first state with the suction head separated from the surface, select a reference coefficient table corresponding to a first suction pressure and a first load of the brush motor, in a second state
(Continued)

with the suction head in contact with the surface, identify a type of the surface based on a second suction pressure, a second load of the brush motor, and the reference coefficient table, and adjust an output of the suction motor and/or the brush motor based on the identified type of the surface to be cleaned.

20 Claims, 16 Drawing Sheets

(51) Int. Cl.

| | |
|---|---|
| ***A46B 13/02*** | (2006.01) |
| ***A46B 15/00*** | (2006.01) |
| ***A47L 9/00*** | (2006.01) |
| ***A47L 9/04*** | (2006.01) |

(52) U.S. Cl.
CPC ..... *A46B 15/0004* (2013.01); *A47L 9/0063* (2013.01); *A47L 9/0411* (2013.01); *A47L 9/0477* (2013.01); *A47L 9/2821* (2013.01); *A47L 9/2826* (2013.01); *A47L 9/2831* (2013.01); *A47L 9/2847* (2013.01); *A47L 9/2857* (2013.01); *A47L 9/2873* (2013.01); *A46B 2200/3033* (2013.01)

(58) Field of Classification Search
CPC .... A47L 9/2826; A47L 9/2831; A47L 9/2847; A47L 9/2857; A47L 9/2873; A46B 13/001; A46B 13/02; A46B 15/0004
See application file for complete search history.

(56) References Cited

U.S. PATENT DOCUMENTS

| | | | | |
|---|---|---|---|---|
| 11,367,276 | B2 * | 6/2022 | Jiang | G06V 20/10 |
| 2021/0186291 | A1 * | 6/2021 | Nguyen | A47L 9/325 |
| 2023/0040611 | A1 * | 2/2023 | Moon | A47L 9/2842 |
| 2023/0104985 | A1 * | 4/2023 | Kwon | A47L 9/2842 15/319 |
| 2023/0292967 | A1 * | 9/2023 | Park | A47L 9/2884 15/319 |
| 2023/0329499 | A1 * | 10/2023 | Lee | A47L 9/2826 |

FOREIGN PATENT DOCUMENTS

| | | | | | |
|---|---|---|---|---|---|
| CN | 117617849 | A | * | 3/2024 | A47L 9/32 |
| CN | 118973456 | A | * | 11/2024 | H02P 25/145 |
| DE | 102019104429 | A1 | * | 8/2020 | A47L 9/0411 |
| EP | 0636341 | A1 | * | 2/1995 | A47L 9/2894 |
| JP | 7-111963 | A | | 5/1995 | |
| JP | 2005-7032 | A | | 1/2005 | |
| JP | 2011-10801 | A | | 1/2011 | |
| JP | 2011010801 | A | * | 1/2011 | |
| JP | 2020-151010 | A | | 9/2020 | |
| KR | 10-1997-0008976 | B1 | | 6/1997 | |
| KR | 970008976 | B1 | * | 6/1997 | B25J 9/1689 |
| KR | 10-0233509 | B1 | | 9/1999 | |
| KR | 10-2019-0018939 | A | | 2/2019 | |
| KR | 10-2020-0132589 | A | | 11/2020 | |
| KR | 10-2021-0073058 | A | | 6/2021 | |
| KR | 10-2021-0128977 | A | | 10/2021 | |
| KR | 20210128977 | A | * | 10/2021 | G05D 1/6485 |
| KR | 10-2022-0042746 | A | | 4/2022 | |
| KR | 20220042746 | A | * | 4/2022 | A47L 9/2842 |
| KR | 20230148079 | A | * | 10/2023 | A47L 9/2894 |
| KR | 20230148084 | A | * | 10/2023 | A47L 9/2821 |
| WO | WO-2022035041 | A1 | * | 2/2022 | A47L 9/2857 |
| WO | WO 2023/224229 | A1 | | 11/2023 | |

OTHER PUBLICATIONS

Written Opinion of the International Searching Authority dated Aug. 18, 2023 for International Application No. PCT/KR2023/005360.

* cited by examiner

FIG. 7

700

| VACUUM CLEANER STATE INFORMATION | CONTROL CONTENT |
|---|---|
| Lift | MINIMIZE OUTPUT |
| Hard floor | REFERENCE OUTPUT |
| Carpet | CONTROL OUTPUT TO BE GREATER THAN REFERENCE OUTPUT |
| Mat | CONTROL OUTPUT TO BE LESS THAN REFERENCE OUTPUT |

FIG. 9

900

| LOAD OF BRUSH MOTOR: L1 [W]<br>SUCTION PRESSURE : P1 [Pa] | COEFFICIENT A | COEFFICIENT B | COEFFICIENT C |
|---|---|---|---|
| FIRST HYPERPLANE (510) | a1 (1.6130) | b1 (−0.7770) | c1 (−2.5640) |
| SECOND HYPERPLANE (520) | a2 (4.9637) | b2 (7.8737) | c2 (−0.8725) |
| THIRD HYPERPLANE (530) | a3 (−0.4717) | b3 (0.6988) | c3 (−0.5240) |

FIG. 10

1000

| LOAD OF BRUSH MOTOR: L2 [W]<br>SUCTION PRESSURE : P2 [Pa] | COEFFICIENT A | COEFFICIENT B | COEFFICIENT C |
|---|---|---|---|
| FIRST HYPERPLANE (510) | a4 (1.7370) | b4 (−0.8073) | c4 (−3.4324) |
| SECOND HYPERPLANE (520) | a5 (5.0405) | b5 (8.0617) | c5 (−1.1563) |
| THIRD HYPERPLANE (530) | a6 (−0.4664) | b6 (0.7180) | c6 (−0.2746) |

FIG. 11

1100

| LOAD OF BRUSH MOTOR: L3 [W]<br>SUCTION PRESSURE : P3 [Pa]<br>ROTATIONAL SPEED: V1 [RPM] | COEFFICIENT D | COEFFICIENT E | COEFFICIENT F | COEFFICIENT G |
|---|---|---|---|---|
| FOURTH HYPERPLANE (610) | d1 | e1 | f1 | g1 |
| FIFTH HYPERPLANE (620) | d2 | e2 | f2 | g2 |
| SIXTH HYPERPLANE (630) | d3 | e3 | f3 | g3 |

CLEANING DEVICE AND CONTROL METHOD THEREOF

CROSS-REFERENCE TO RELATED APPLICATION(S)

This application is a continuation application, under 35 U.S.C. § 111(a), of international application No. PCT/KR2023/005360, filed on Apr. 20, 2023, which claims priority to Korean Patent Application No. 10-2022-0059165, filed on May 13, 2022, and No. 10-2022-0118222, filed on Sep. 19, 2022 in the Korean Intellectual Property Office, the disclosures of which are incorporated by reference herein in their entireties.

BACKGROUND

1. Field

The disclosure relates to a cleaning device including a suction head provided with a rotating brush, and a control method thereof.

2. Description of Related Art

A cleaning device is a home appliance for cleaning a place such as a floor in an indoor/outdoor space. The cleaning device may include a vacuum cleaner and a docking station. The vacuum cleaner includes a suction motor configured to generate suction force, a suction head configured to suction air and foreign substances from a cleaning surface using the suction force of the suction motor, and a foreign substance collection chamber configured to separate foreign substances from the air sucked through the suction head and to collect the foreign substances. The suction head includes a housing including a suction port, and a brush configured to sweep the cleaning surface to efficiently suction foreign substances on the cleaning surface into the suction port. The brush may be connected to a brush motor so as to be rotatable. The vacuum cleaner may clean a variety of cleaning surfaces. For example, the vacuum cleaner may suction foreign substances placed on a carpet, a hard floor, or a mat.

SUMMARY

Aspects of the disclosure will be set forth in part in the description which follows and, in part, will be obvious from the description, or may be learned by practice of the disclosure.

According to an embodiment of the disclosure, a cleaning device may include a body; a suction motor arranged in the body and configured to generate a suction force; a suction head including a suction port through which foreign substances are sucked by the suction force; a brush configured to rotate inside the suction head; a brush motor configured to rotate the brush; a pressure sensor configured to detect a suction pressure at the suction port; a memory configured to store a plurality of coefficient tables including coefficients of a hyperplane equation for determining a type of surface to be cleaned; and a controller configured to control the suction motor, the brush motor, the pressure sensor, and the memory. The controller may be configured to, in a first state in which the suction head is separated from the surface to be cleaned, select from the memory a reference coefficient table corresponding to a first detected suction pressure at the suction port and a first load of the brush motor, in a second state in which the suction head is in contact with the surface to be cleaned, identify a type of the surface to be cleaned based on a second detected suction pressure at the suction port, a second load of the brush motor; and the selected reference coefficient table, and adjust at least one of an output of the suction motor and an output of the brush motor based on the identified type of the surface to be cleaned.

According to an embodiment of the disclosure, the controller is configured to determine, based on the selected reference coefficient table, a plurality of linear equations related to a plurality of hyperplanes on a two-dimensional coordinate plane, and identify the type of the surface to be cleaned based on a position of coordinates corresponding to the second detected suction pressure and the second load of the brush motor on the two-dimensional coordinate plane.

According to an embodiment of the disclosure, the controller is configured to select from the memory the reference coefficient table further corresponding to a first rotational speed of the brush motor obtained in the first state, and identify the type of the surface to be cleaned further based on a second rotational speed of the brush motor obtained in the second state.

According to an embodiment of the disclosure, the controller is configured to determine, based on the selected reference coefficient table, a plurality of plane equations related to a plurality of hyperplanes in a three-dimensional coordinate space, and identify the type of the surface to be cleaned based on a position of coordinates corresponding to the second detected suction pressure, the second load of the brush motor, and the second rotational speed of the brush motor in the three-dimensional coordinate space.

According to an embodiment of the disclosure, the cleaning device further includes a user interface configured to obtain a user input, wherein the controller is configured to drive the suction motor and the brush motor in response to obtaining the user input for entering a diagnosis mode in the first state to determine the first detected suction pressure and the first load of the brush motor.

According to an embodiment of the disclosure, the cleaning device further includes a docking station configured to be coupled to the body, wherein the controller is configured to drive the suction motor and the brush motor based on the body being coupled to the docking station and entering a diagnosis mode to determine the first detected suction pressure and the first load of the brush motor.

According to an embodiment of the disclosure, the controller is configured to select, as the reference coefficient table, a coefficient table including values equal to the first detected suction pressure and the first load of the brush motor among the plurality of coefficient tables.

According to an embodiment of the disclosure, the controller is configured to select, as the reference coefficient table, a coefficient table including values closest to the first detected suction pressure and the first load of the brush motor among the plurality of coefficient tables.

According to an embodiment of the disclosure, the controller is configured to select a plurality of candidate tables including values within a predetermined error range of each of the first detected suction pressure and the first load of the brush motor, from among the plurality of coefficient tables, and determine the reference coefficient table by linearly interpolating the plurality of candidate tables.

According to an embodiment of the disclosure, the controller is configured to determine the first load of the brush motor or the second load of the brush motor based on a current applied to the brush motor or power consumption of the brush motor.

According to an embodiment of the disclosure, a method of controlling a cleaning device may include driving a suction motor and a brush motor of the cleaning device in a first state in which a suction head is separated from a surface to be cleaned; determining a first suction pressure at a suction port in the suction head and a first load of the brush motor in the first state; selecting a reference coefficient table corresponding to the first suction pressure and the first bad of the brush motor, from among a plurality of coefficient tables related to a hyperplane equation stored in a memory; driving the suction motor and the brush motor in a second state in which the suction head is in contact with the surface to be cleaned; determining a second suction pressure of the suction port and a second load of the brush motor in the second state; identifying a type of the surface to be cleaned based on the second suction pressure at the suction port, the second load of the brush motor, and the reference coefficient table; and adjusting at least one of an output of the suction motor and an output of the brush motor based on the identified type of the surface to be cleaned.

According to an embodiment of the disclosure, the identifying the type of the surface to be cleaned includes determining, based on the selected reference coefficient table, a plurality of linear equations related to a plurality of hyperplanes on a two-dimensional coordinate plane, and identifying the type of the surface to be cleaned based on a position of coordinates corresponding to the second suction pressure and the second load of the brush motor on the two-dimensional coordinate plane.

According to an embodiment of the disclosure, the selecting the reference coefficient table is further based on a first rotational speed of the brush motor obtained in the first state; and the identifying the type of the surface to be cleaned is further based on a second rotational speed of the brush motor obtained in the second state.

According to an embodiment of the disclosure, the identifying the type of the surface to be cleaned includes determining, based on the selected reference coefficient table, a plurality of plane equations related to a plurality of hyperplanes in a three-dimensional coordinate space, and identifying the type of the surface to be cleaned based on a position of coordinates corresponding to the second suction pressure, the second load of the brush motor, and the second rotational speed of the brush motor in the three-dimensional coordinate space.

According to an embodiment of the disclosure, the driving of the suction motor and the brush motor in the first state is performed in response to obtaining a user input, which is for entering a diagnosis mode, through a user interface.

According to an embodiment of the disclosure, the driving of the suction motor and the brush motor in the first state is performed based on a body of the cleaning device being coupled to a docking station and entering a diagnosis mode.

According to an embodiment of the disclosure, the reference coefficient table is a coefficient table including values equal to the first suction pressure and the first load of the brush motor among the plurality of coefficient tables.

According to an embodiment of the disclosure, the reference coefficient table is a coefficient table including values closest to the first suction pressure and the first load of the brush motor among the plurality of coefficient table.

According to an embodiment of the disclosure, the selecting the reference coefficient table includes selecting a plurality of candidate tables including values within a predetermined error range of each of the first suction pressure and the first load of the brush motor, from among the plurality of coefficient tables, and determining the reference coefficient table by linearly interpolating the plurality of candidate tables.

According to an embodiment of the disclosure, the first load or the second load of the brush motor is determined based on a current applied to the brush motor or power consumption of the brush motor.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 7 is a table illustrating an example in which at least one of an output of a suction motor and an output of a brush motor is adjusted according to the type of cleaning surface according to an embodiment of the disclosure;

FIG. 9 illustrates a coefficient table related to a hyperplane equation in the two-dimensional coordinate system according to an embodiment of the disclosure;

FIG. 10 illustrates a coefficient table related to a hyperplane equation in the two-dimensional coordinate system according to an embodiment of the disclosure;

FIG. 11 illustrates a coefficient table related to a hyperplane equation in the three-dimensional coordinate system according to an embodiment of the disclosure;

DETAILED DESCRIPTION

Figure 1:
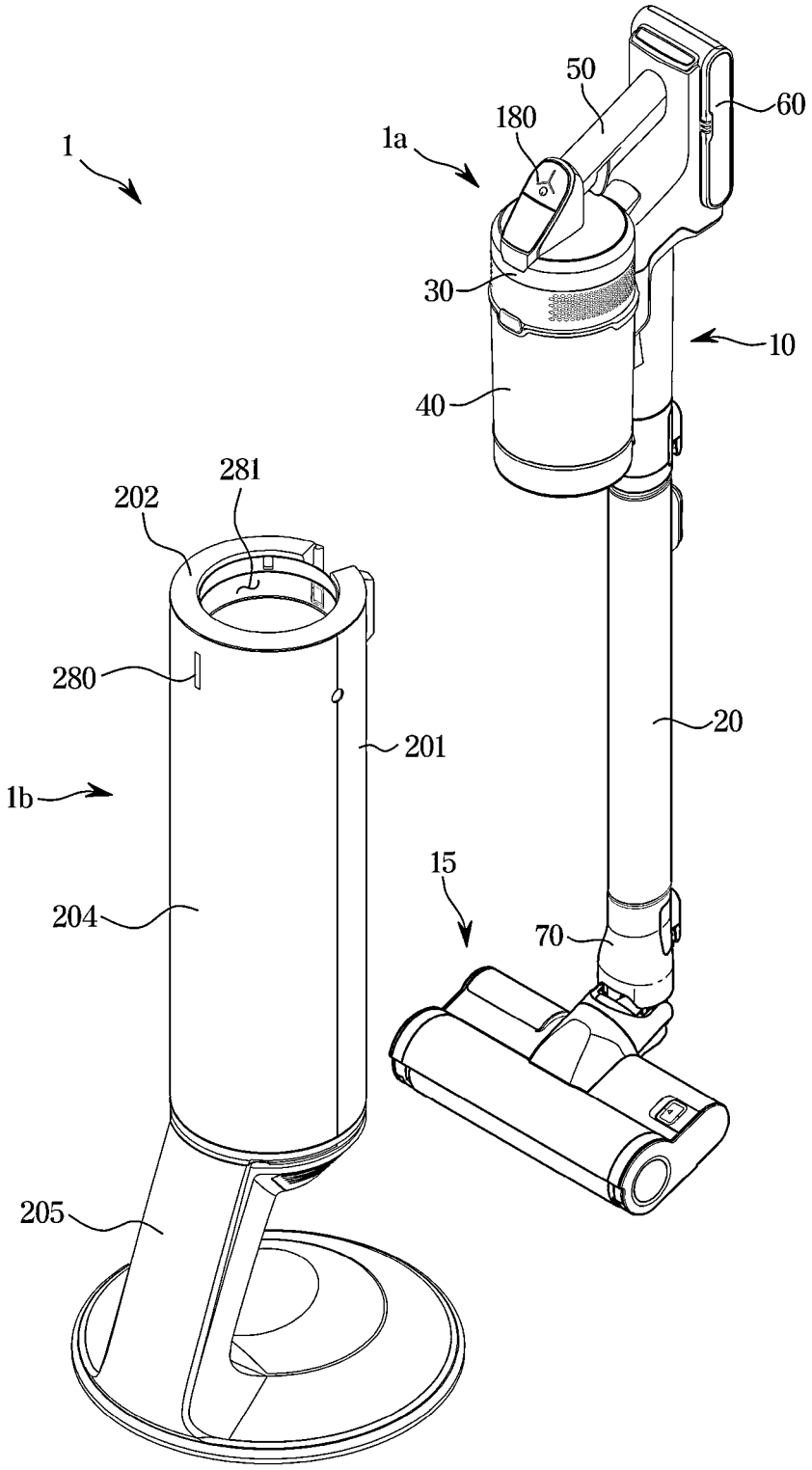
FIG. 1 illustrates a cleaning device including a vacuum cleaner and a docking station according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

It will be understood that when an element is referred to as being "connected" another element, it can be directly or indirectly connected to the other element, wherein the indirect connection includes "connection via a wireless communication network".

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following description, terms such as "unit", "part", "block", "member", and "module" may indicate a unit for processing at least one function or operation. For example, those terms may refer to at least one process processed by at least one hardware such as a Field Programmable Gate Array (FPGA), Application Specific Integrated Circuit (ASIC), at least one software stored in a memory or a processor.

An identification code is used for the convenience of the description but is not intended to illustrate the order of each step. The each step may be implemented in an order different from the illustrated order unless the context clearly indicates otherwise.

Embodiments of the disclosure may provide a cleaning device capable of changing a reference for classifying a type of a cleaning surface in consideration of deterioration of a vacuum cleaner and a control method thereof.

Reference will now be made in detail to embodiments of the disclosure, examples of which are illustrated in the accompanying drawings.

FIG. 1 illustrates a cleaning device including a vacuum cleaner and a docking station according to an embodiment.

Referring to FIG. 1, a cleaning device 1 may include a vacuum cleaner 1*a* and a docking station 1*b* configured to be coupled to the vacuum cleaner 1*a* and configured to remove foreign substances stored in a dust collection container 40 of the vacuum cleaner 1*a*.

The vacuum cleaner 1*a* may include a body 10, a suction head 15, and an extension pipe 20 connecting the body 10 and the suction head 15. The body 10 may include a suction force generating device 30 configured to generate a suction force, the dust collection container 40 configured to separate and collect foreign substances from sucked air, a handle 50 provided to be gripped by a user, and a battery 60 configured to supply power for operation of the vacuum cleaner 1*a*. Further, the vacuum cleaner 1*a* may include a user interface 180 configured to obtain a user input.

The suction force generating device 30 may include a suction motor configured to convert electric power into mechanical rotational force, and a suction fan configured to be rotated by being connected to the suction motor.

The dust collection container 40 may collect foreign substances through a cyclone method of separating foreign substances using centrifugal force or a dust bag method of separating foreign substances by passing air through a filtering bag. Air passing through the dust collection container 40 may be discharged to the outside of the body 10.

The extension pipe 20 may be formed with a pipe or flexible hose having a predetermined rigidity. The extension pipe 20 may transfer the suction force generated by the suction force generating device 30 to the suction head 15, and guide air and foreign substances sucked through the suction head 15 to the body 10. The suction head 15 may be in close contact with a cleaning surface to suction air and foreign substances on the cleaning surface. The suction head 15 may be rotatably coupled to the extension pipe 20.

The docking station 1*b* may include a docking housing 202 provided to be coupled (docked) with the vacuum cleaner 1*a*. The docking housing 202 may include a mounting member 281 on which the body 10 of the vacuum cleaner 1*a* is mounted. Particularly, as the dust collection container 40 of the vacuum cleaner 1*a* is coupled to the mounting member 281, the vacuum cleaner 1*a* and the docking station 1*b* may be coupled.

A user can mount the vacuum cleaner 1*a* on the docking station 1*b* by coupling the dust collection container 40 of the vacuum cleaner 1*a* to the mounting member 281. The docking station 1*b* may include a support member 205 connected to a lower portion of a body 201. The support member 205 may be connected to one side of the body 201 of the docking station 1*b*, and may extend in a vertical direction to allow the body 201 of the docking station 1*b* to be spaced apart from a floor.

When the vacuum cleaner 1*a* and the docking station 1*b* are coupled, the suction head 15 of the vacuum cleaner 1*a* may be located in a space between the body 201 and the support member 205 of the docking station 1*b*. That is, the suction head 15 of the vacuum cleaner 1*a* may be spaced apart from the floor.

The docking station 1*b* may include a panel 204 arranged on a front surface of the body 201 and removable from the body 201. The panel 204 may be arranged on the side surface or rear surface as well as the front surface of the body 201, and provided to be removable from the body 201. When the panel 204 is separated from the body 201, a user can open a collector provided in the body 201 and easily replace a dust bag of the collector.

The docking station 1*b* may include a display 280 displaying an operating state of the docking station 1*b*. For example, the display 280 may include a light emitting diode (LED) panel. The location and type of display 280 is not limited thereto.

When the vacuum cleaner 1*a* and the docking station 1*b* are coupled, the docking station 1*b* may perform a foreign substance collection operation for removing foreign substances contained in the dust collection container 40 by changing airflow formed inside the dust collection container 40 of the vacuum cleaner 1*a*. For this, the docking station 1*b* may include a separate suction motor.

Further, the docking station 1*b* may supply charging power for charging the battery 60 of the vacuum cleaner 1*a*. A charging terminal 275 may be arranged on one side of the docking housing 202. When the vacuum cleaner 1*a* and the docking station 1*b* are coupled, the charging terminal 275 may be in contact with the battery 60, and supply charging power to the battery 60 through the charging terminal 270.

Based on whether the battery 60 of the vacuum cleaner 1*a* is electrically connected to the charging terminal 275 of the docking station 1*b*, the vacuum cleaner 1*a* may identify the coupling with the docking station 1*b*.

Figure 2:
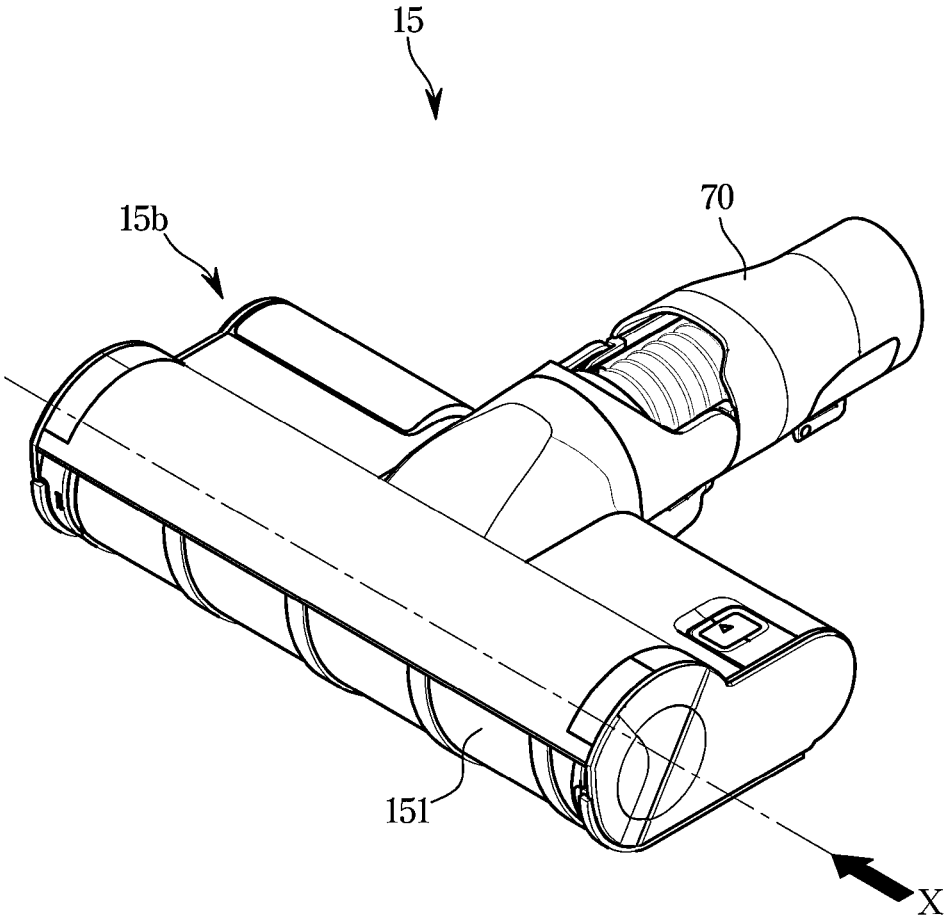
FIG. 2 illustrates a suction head of the vacuum cleaner according to an embodiment of the disclosure.
Figure 3:
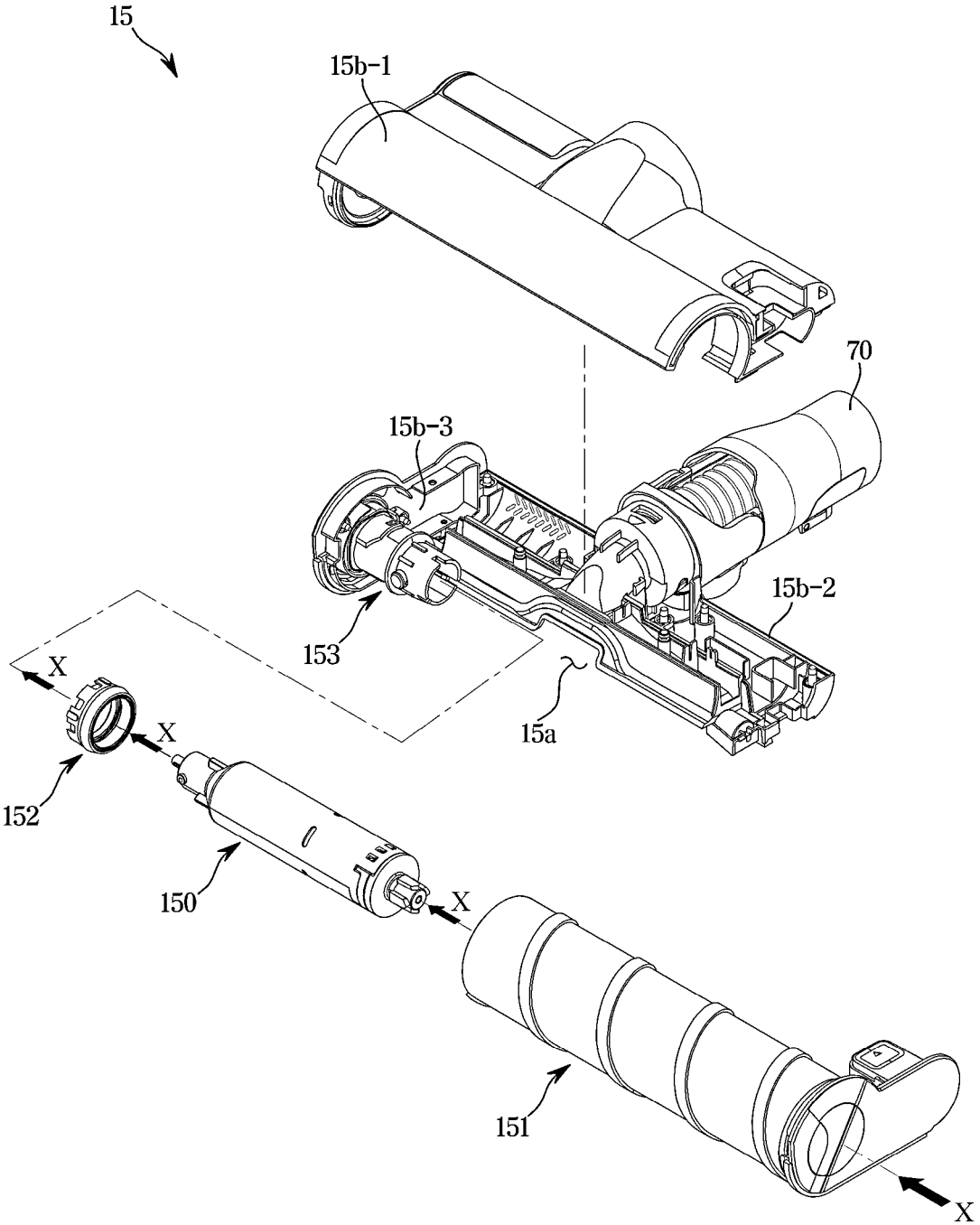
FIG. 3 is an exploded view of the suction head according to an embodiment of the disclosure.

FIG. 2 illustrates a suction head of the vacuum cleaner according to an embodiment. FIG. 3 is an exploded view of the suction head according to an embodiment.

Referring to FIGS. 2 and 3, the suction head 15 may include a housing 15*b* including a suction port 15*a*, a brush 151 configured to be rotated to allow foreign substances to be effectively sucked into the housing 15*b* through the suction port 15*a*, and a suction connector 70 connecting the housing 15*b* and the extension pipe 20.

A module coupling direction X may be defined along a rotation axis of the brush 151. A bearing module 152, a brush motor 150, and the brush 151 may be coupled to the housing 15*b* of the suction head 15 with respect to the module coupling direction X. For example, the housing 15*b* of the suction head 15 may be formed by assembling an upper housing 15*b*-1, a lower housing 15*b*-2, and a side housing 15*b*-3.

The suction head 15 may include a connector module 153. The connector module 153 may be fixed to the side housing 15*b*-3. The connector module 153 may be coupled to the brush motor 150 and may supply power to allow the brush motor 150 to be driven. An electric wire (not shown) provided to supply power may be connected from the battery 60, and extend through the body 10, the extension pipe 20, the suction connector 70, the lower housing 15*b*-2, and the side housing 15*b*-3, sequentially, and then finally electrically connected to a connector of the connector module 153.

The brush motor 150 may be provided in a bottle shape. A case of the brush motor 150 may be provided in a bottle shape, and may be provided to enclose and protect detailed components of the brush motor 150. The bottle shape may refer to a shape including a cylindrical body having a predetermined diameter and a neck connected to the body and having a diameter less than the diameter of the body.

A plug connected to the connector of the connector module 153 may be fixed to the neck of the brush motor 150. A brush driving shaft may be arranged at one end, in which the plug is arranged, and at the other end in the rotation axis direction of the brush 151. Driving force generated by the brush motor 150 may be transmitted to the brush 151 through the brush driving shaft. Therefore, the brush 151 may be rotated.

The brush 151 may be provided in a cylindrical shape with an empty space formed along the rotation axis (X-axis), and the brush motor 150 may be mounted on the empty space formed along the rotation axis. The connector module 153, the bearing module 152, and the brush motor 150 may be accommodated in the empty space of the brush 151. The brush 151 may be rotated by the driving force transmitted from the brush motor 150. The brush 151 may scatter foreign substances placed on the cleaning surface to allow the foreign substances to be efficiently sucked through the suction port 15*a*.

The suction head 15 is not limited to that described in FIGS. 2 and 3. For example, the brush motor 150 provided in the suction head 15 may be provided in a manner in which the brush motor 150 is arranged outside the brush 151 and transmits power through a pulley structure, which is different from a manner in which the brush motor 150 is inserted into the inside of the brush 151 to transmit power through a meshing structure. The suction head 15 may be provided in various structures including the brush 151 for increasing power for suctioning foreign substances through the suction port 15*a*.

Figure 4:
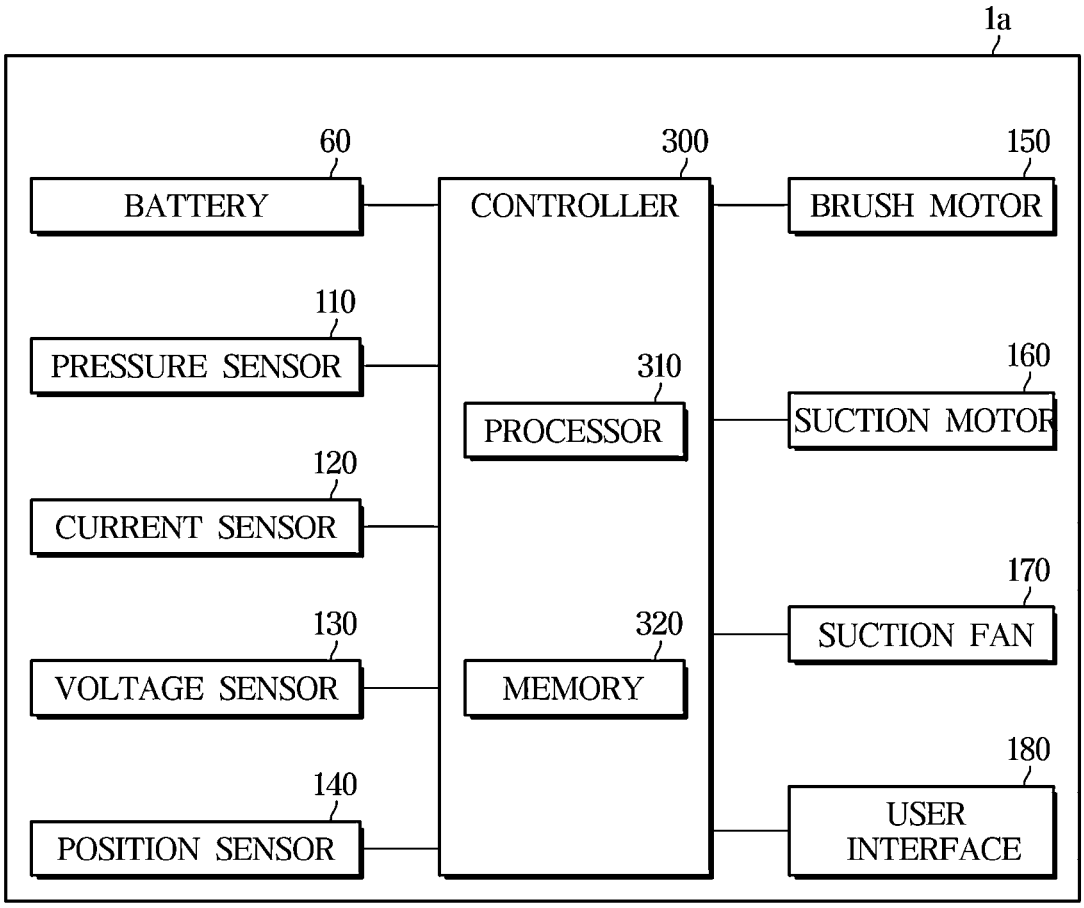
FIG. 4 is a control block diagram of the vacuum cleaner according to an embodiment of the disclosure.

FIG. 4 is a control block diagram of the vacuum cleaner 1*a* according to an embodiment.

Referring to FIG. 4, the vacuum cleaner 1*a* may include the battery 60, a pressure sensor 110, a current sensor 120, a voltage sensor 130, a position sensor 140, the brush motor 150, a suction motor 160, a suction fan 170, the user interface 180, and a controller 300. Components of the vacuum cleaner 1*a* are not limited thereto. Some of the illustrated components may be omitted or other component other than the illustrated components may be added. For example, the vacuum cleaner 1*a* may further include a communication device for communicating with an external device.

The battery 60 may supply power to electronic components of the vacuum cleaner 1*a*. For example, the battery 60 may supply power to the brush motor 150 and the suction motor 160. When the vacuum cleaner 1*a* is coupled to the docking station 1*b*, the battery 60 may be connected to an external power source and may be charged by power supplied from the external power source.

The pressure sensor 110 may detect a pressure of the suction port 15*a* provided on the suction head 15. The pressure of the suction port 15*a* may mean a pressure of air flowing through the suction port 15*a*. Further, the pressure sensor 110 may detect atmospheric pressure. The pressure sensor 110 may transmit an electrical signal corresponding to the pressure of the suction port 15*a* and/or the atmospheric pressure to the controller 300.

For example, the pressure sensor 110 may include a first pressure sensor configured to measure atmospheric pressure and a second pressure sensor configured to measure a pressure of the suction port 15*a*. The pressure sensor 110 may be a relative pressure sensor configured to output a difference between a sensing value by the first pressure sensor and a sensing value by the second pressure sensor. There is no limitation in the location of the first pressure sensor as long as the first pressure sensor is configured to measure the atmospheric pressure, and the second pressure sensor may be arranged on one side of the suction port 15*a* to measure the pressure of the suction port 15*a*. According to embodiments, the second pressure sensor may be arranged on one side of the suction connector 70 or the extension pipe 20 connected to the suction port 15*a*.

As another example, the pressure sensor 110 may be an absolute pressure sensor configured to measure a pressure of air flowing through the suction port 15*a*. The controller 300 may determine atmospheric pressure based on a signal transmitted from the pressure sensor 110 before the suction motor 160 is operated. The controller 300 may determine the pressure of the suction port 15*a* based on a signal transmitted from the pressure sensor 110 while the suction motor 160 is operated.

The controller 300 may determine the suction pressure based on the atmospheric pressure and the pressure of the suction port 15*a*. Even when the atmospheric pressure changes according to the external environment, the controller 300 may determine an actual pressure according to the foreign substances by determining the suction pressure corresponding to the difference between the atmospheric pressure and the pressure of the suction port 15*a*. In other words, the controller 300 may accurately determine the suction pressure corresponding to the actual pressure for sucking foreign substances even when the atmospheric pressure changes according to the external environment.

According to embodiments, the suction pressure of the suction port 15*a* may also be determined by the pressure sensor 110. That is, the pressure sensor 110 may transmit an electrical signal corresponding to a difference between the atmospheric pressure and the pressure of the suction port 15*a* to the controller 300.

The current sensor 120 may detect a current applied to the brush motor 150. The current sensor 120 may be provided with various ammeters. The voltage sensor 130 may detect a voltage applied to the brush motor 150. The voltage sensor 130 may be provided with various voltmeters. Although it is described that the current sensor 120 and the voltage sensor 130 are separated, the current sensor 120 and the voltage sensor 130 may be provided as a single device. Further, the current and voltage applied to the brush motor 150 may be detected by the controller 300, and in this case, the controller 300 may serve as the current sensor 120 and the voltage sensor 130.

The position sensor 140 may detect a position state of the vacuum cleaner 1*a*. For example, the position sensor 140 may detect a first state in which the suction head 15 of the vacuum cleaner 1*a* is separated from the cleaning surface (i.e., a lift state) or a second state in which the suction head 15 is in contact with the cleaning surface. The position sensor 140 may be arranged on the suction head 15 and may be provided with various sensors such as an optical sensor, an infrared sensor, and a piezoelectric sensor. The position sensor 140 may transmit an electrical signal corresponding to the position state of the vacuum cleaner 1*a* to the controller 300. The controller 300 may identify the position state of the vacuum cleaner 1*a* based on the signal of the position sensor 140.

The brush motor 150 may rotate the brush 151. The suction motor 160 may rotate the suction fan 170. As the suction fan 170 is rotated, a suction force for sucking foreign substances may be generated. The controller 300 may adjust an output of the brush motor 150. Further, the controller 300 may adjust an output of the suction motor 160. The output of the brush motor 150 and the output of the suction motor 160 may mean power consumption of each motor.

The controller 300 may determine a load of the brush motor 150 based on the current applied to the brush motor 150. For example, when the brush motor 150 is set to maintain a predetermined rotational force and/or rotational speed, the current applied to the brush motor 150 may vary according to the resistance of the cleaning surface. When the rotation of the brush 151 is interrupted by the cleaning surface, the rotational force and/or rotational speed of the brush motor 150 may decrease. The controller 300 may increase the current applied to the brush motor 150 to maintain the rotational force of the brush motor 150. The controller 300 may determine that the load of the brush motor 150 increases when the current applied to the brush motor 150 increases.

Further, the controller 300 may determine the load of the brush motor 150 based on the power consumption of the brush motor 150. The controller 300 may determine the power consumption of the brush motor 150 based on the current applied to the brush motor 150 and the voltage applied to the brush motor 150. When the current applied to the brush motor 150 increases, the power consumption of the brush motor 150 also increases. The controller 300 may determine that the load of the brush motor 150 increases when the power consumption of the brush motor 150 increases.

The user interface 180 may include a display provided to display information about the state and/or operation of the vacuum cleaner 1*a*. The user interface 180 may include an input interface for obtaining a user input. Further, the user interface 180 may include a speaker provided to output sound.

The display may be provided with a liquid crystal display panel (LCD) panel, a light emitting diode (LED) panel, an organic light emitting diode (OLED) panel, or a micro-LED panel. The display device may be provided as a touch display.

The input interface may include various buttons for obtaining a user input. For example, the input interface may include a power button and an operating mode button. The controller 300 may start or stop a cleaning operation based on a user input through the power button. The controller 300 may adjust the suction force of the vacuum cleaner 1*a* to weak, medium, strong, or super strong based on a user input through the operation mode button. The controller 300 may adjust the output of the suction motor 160 in response to the strength of the suction force that is set through the operation mode button.

The operation mode of the vacuum cleaner 1*a* may further include a diagnosis mode for diagnosing a state of the vacuum cleaner 1*a*. The controller 300 may enter the diagnosis mode in the first state (i.e., the lift state) in which the suction head 15 of the vacuum cleaner 1*a* is separated from the cleaning surface.

For example, the controller 300 may enter the diagnosis mode based on obtaining a user input for entering the diagnosis mode through the user interface 180 in the first state (lift state). A user input for entering the diagnosis mode may be obtained through the operation mode button of the user interface 180. When a user selects the diagnosis mode by manipulating the operation mode button, the user interface 180 may transmit a diagnosis execution command corresponding to the selection of the diagnosis mode to the controller 300.

In addition, the controller 300 may enter the diagnosis mode in response to identifying the coupling of the vacuum cleaner 1*a* and the docking station 1*b*. When the vacuum cleaner 1*a* and the docking station 1*b* are coupled, the suction head 15 of the vacuum cleaner 1*a* may be located in the space between the body 201 and the support member 205 of the docking station 1*b*. That is, the suction head 15 of the vacuum cleaner 1*a* may be spaced apart from the floor. Accordingly, when the body 10 of the vacuum cleaner 1*a* is coupled to the docking station 1*b*, the controller 300 may determine that the vacuum cleaner 1*a* is in the first state (lift state).

The controller 300 may be electrically connected to components of the vacuum cleaner 1*a* and may control the operation of the vacuum cleaner 1*a*. The controller 300 may include a memory 320 and a processor 310. The memory 320 may memorize/store various types of information necessary for the operation of the vacuum cleaner 1*a*. The memory 320 may store instructions, applications, data and/or programs necessary for the operation of the vacuum cleaner 1*a*.

The memory 320 may include a volatile memory such as a static random access memory (S-RAM) or a dynamic random access memory (D-RAM) for temporarily storing data. In addition, the memory 320 may include a non-volatile memory such as a read only memory (ROM), an erasable programmable read only memory (EPROM), or an electrically erasable programmable read only memory (EEPROM) for long-term storage of data.

The processor 310 may generate a control signal for controlling the operation of the vacuum cleaner 1*a* based on instructions, applications, data, and/or programs stored in the memory 320. The processor 310 is hardware and may include a logic circuit and an arithmetic circuit. The processor 310 may process data according to a program and/or instructions provided from the memory 320 and may generate a control signal according to a processing result. The memory 320 and the processor 310 may be implemented as one control circuit or as a plurality of circuits.

Although not shown, the docking station 1*b* may also include a separate processor and memory.

The memory 320 may store suction pressure data of the vacuum cleaner 1*a* and load data of the brush motor 150. Further, the memory 320 may further store rotational speed data of the brush motor 150. The rotational speed of the brush motor 150 may mean revolutions per minute (RPM).

The memory 320 may store coefficient data of a hyperplane equation used to identify the type of cleaning surface. Coefficient data of hyperplane equations may be determined by a support vector machine (SVM) model. The coefficient data may include coefficients of a hyperplane equation in a two-dimensional (2D) coordinate system or a three-dimensional (3D) coordinate system. In the 2D coordinate system, a hyperplane equation may mean a linear equation, and in the 3D coordinate system, a hyperplane equation may mean a plane equation. A hyperplane may be a reference for determining the type of cleaning surface.

The coefficient data may be stored in the memory 320 when the vacuum cleaner 1*a* is manufactured. The coefficient data may be stored in a plurality of coefficient tables. Each of the plurality of coefficient tables related to the hyperplane in the 2D coordinate system may include respective coefficients of a plurality of linear equations having the load of the brush motor 150 and the suction pressure of the suction port 15*a* as variables. Each of the plurality of coefficient tables related to the hyperplane in the 3D coordinate system may include respective coefficients of a plurality of plane equations having the load of the brush motor 150, the suction pressure of the suction port 15*a*, and the rotational speed of the brush motor 150 as variables.

The controller 300 may determine a hyperplane using coefficient data of the hyperplane equation. The hyperplane may mean a boundary line or boundary plane dividing a plurality of driving data. One or more hyperplanes may be determined.

For example, when a variable of the x-axis is the suction pressure and a variable of the y-axis is the load of the brush motor 150 in the 2D coordinate system, the suction pressure data and the load data of the brush motor 150 may be represented by a plurality of points in the 2D coordinate system. The equation of the hyperplane may be determined as a linear equation in the 2D coordinate system in which the suction pressure and the load of the brush motor 150 are variables of the coordinate axes. Therefore, the hyperplane may be determined as a straight line on the 2D coordinate plane.

As another example, when a variable of the x-axis is the suction pressure, a variable of the y-axis is the load of the brush motor 150, and a variable of the z-axis is the rotational speed of the brush motor 150 in the 3D coordinate space, the suction pressure data, the load data of the brush motor 150 and the rotational speed data of the brush motor 150 may be represented by a plurality of points in the 3D coordinate space. The equation of the hyperplane may be determined as a plane equation in the 3D coordinate system in which the suction pressure, the load of the brush motor 150, and the rotational speed of the brush motor 150 are variables of the coordinate axes. Therefore, the hyperplane may be determined as a plane in the 3D coordinate space.

The controller 300 may identify the type of cleaning surface in contact with the suction head 15 by using the suction pressure, the load of the brush motor 150, and the hyperplane equation. For example, on the 2D coordinate plane including the hyperplane, the controller 300 may identify the type of the cleaning surface based on the position of the coordinates corresponding to the load of the brush motor 150 and the suction pressure obtained during the cleaning operation of the vacuum cleaner 1*a*. In addition, in the 3D coordinate space including the hyperplane, the controller 300 may identify the type of the cleaning surface based on the position of the coordinates corresponding to the suction pressure, the load of the brush motor 150, and the rotational speed of the brush motor 150 obtained during the cleaning operation of the vacuum cleaner 1*a*.

The controller 300 may adjust at least one of the output of the suction motor 160 and the output of the brush motor 150 based on the identified type of the cleaning surface. For example, based on the cleaning surface being identified as a hard floor, the controller 300 may adjust at least one of the output of the suction motor 160 and the output of the brush motor 150 to a reference output. Based on the cleaning surface being identified as a carpet, the controller 300 may adjust at least one of the output of the suction motor 160 and the output of the brush motor 150 to an output greater than the reference output. Based on the cleaning surface being identified as a mat, the controller 300 may adjust at least one of the output of the suction motor 160 and the output of the brush motor 150 to an output less than the reference output. In addition, the controller 300 may minimize the output of the brush motor 150 and the output of the suction motor 160 based on the suction head 15 as being identified as a state, in which the suction head 15 is located in the air, that is, the lift state.

As mentioned above, the vacuum cleaner 1*a* may increase a use time of the battery 60 and the cleaning performance by adjusting at least one of the output of the brush motor 150 and the output of the suction motor 160 according to the type of the cleaning surface.

Meanwhile, as the cumulative use time of the vacuum cleaner 1*a* increases, the vacuum cleaner 1*a* may deteriorate. Due to the deterioration of the vacuum cleaner 1*a*, the performance of devices such as the battery 60, the brush motor 150 and the suction motor 160 may change. For example, when the new vacuum cleaner 1*a* and the aged vacuum cleaner 1*a* are compared, the suction pressure and the load of the brush motor 150 detected while cleaning the same cleaning surface may be different. When the brush 151 is worn, friction with the cleaning surface may be reduced, and thus power consumption of the brush motor 150 may be reduced. The reduction in performance of the suction motor 160 may cause a reduction in suction pressure.

In order to apply the change in the suction pressure, the change in the load of the brush motor 150, and/or the change in the rotational speed of the brush motor 150 caused by the deterioration of the vacuum cleaner 1*a*, it may be required to appropriately change the hyperplane that is the reference for identifying the types of the cleaning surfaces. When the hyperplane is not changed despite of the reduction in performance of the vacuum cleaner 1*a*, the type of cleaning surface may be incorrectly identified. In this case, it may cause a misunderstanding of product failure to consumers, and may adversely affect the cleaning performance and battery performance. Therefore, it is required to appropriately change the hyperplane according to the deterioration of the vacuum cleaner 1*a*.

The disclosed vacuum cleaner 1*a* may easily change a hyperplane by selecting a coefficient table corresponding to the current state of the vacuum cleaner 1*a* from among the plurality of coefficient tables stored in the memory 320. The coefficient table corresponding to the current state of the vacuum cleaner 1*a* may be referred to as a 'reference coefficient table'.

The controller 300 may select a reference coefficient table in the diagnosis mode of the vacuum cleaner 1*a*. Entry into the diagnosis mode may be performed in the first state (i.e., the lift state) in which the suction head 15 of the vacuum cleaner 1*a* is separated from the cleaning surface. When entering the diagnosis mode, the controller 300 may drive the suction motor 160 and the brush motor 150 to determine a first suction pressure of the suction port 15*a* and a first load of the brush motor 150. The controller 300 of the vacuum cleaner 1*a* may select a reference coefficient table, which corresponds to the first suction pressure of the suction port 15*a* and the first load of the brush motor 150 which are determined in the first state, among the plurality of coefficient tables stored in the memory 320.

For example, the controller 300 may select a coefficient table, which includes values equal to the first suction pressure and the first load, as a reference coefficient table, or select a coefficient table, which includes values closest to the first suction pressure and the first load, as a reference coefficient table. In addition, the controller 300 may select a plurality of candidate tables, which includes values within a predetermined error range of each of the first suction pressure and the first load, from among the plurality of coefficient tables, and then select a reference coefficient table by linearly interpolating the plurality of candidate tables.

In addition, the controller 300 of the vacuum cleaner 1*a* may further detect a first rotational speed of the brush motor 150 when entering the diagnosis mode. In other words, the controller 300 may select a reference coefficient table, which corresponds to the first suction pressure of the suction port 15*a*, the first load of the brush motor 150, and the first rotational speed of the brush motor 150 which are determined in the first state, from the plurality of coefficient tables stored in the memory 320.

For example, the controller 300 may select a coefficient table, which includes values equal to the first suction pressure, the first load, and the first rotational speed, as a reference coefficient table, or select a coefficient table, which includes values closest to the first suction pressure, the first load, and the first rotational speed, as a reference coefficient table. Further, the controller 300 may select a plurality of candidate tables, which includes values within a predetermined error range of each of the first suction pressure, the first load, and the first rotational speed, from among the plurality of coefficient tables, and then select a reference coefficient table by linearly interpolating the plurality of candidate tables.

When the vacuum cleaner 1*a* is separated from the cleaning surface, there is no resistance of the cleaning surface applied to the brush 151, and thus it is possible to more accurately diagnose the current state of the vacuum cleaner 1*a*. That is, in order to more accurately determine the change in the suction pressure, the change in the load of the brush motor 150, and the change in the rotational speed of the brush motor 150 caused by the deterioration of the vacuum cleaner 1*a*, it is appropriate to diagnose the current state of the vacuum cleaner 1*a* in the lift state.

The controller 300 may determine a plurality of linear equations related to a plurality of hyperplanes on the 2D coordinate plane by using the selected reference coefficient table. Thereafter, in the second state in which the suction head 15 is in contact with the cleaning surface, the controller 300 may determine a second suction pressure of the suction port 15*a* and a second load of the brush motor 150 by driving the brush motor 150 and the suction motor 160. The controller 300 may identify the type of the cleaning surface based on the position of the coordinates corresponding to the second suction pressure and the second load, on the 2D coordinate plane.

When the rotational speed of the brush motor 150 is applied for selecting the reference coefficient table, the controller 300 may determine a plurality of plane equations related to a plurality of hyperplanes in the 3D coordinate space by using the selected reference coefficient table. In the second state in which the suction head 15 is in contact with the cleaning surface, the controller 300 may determine the second suction pressure of the suction port 15*a*, the second load of the brush motor 150, and a second rotational speed of the brush motor 150 by driving the brush motor 150 and the suction motor 160. The controller 300 may identify the type of the cleaning surface based on the position of coordinates corresponding to the second suction pressure, the second load, and the second rotational speed, in the 3D coordinate space.

As mentioned above, the disclosed vacuum cleaner 1*a* may self-diagnose the current state and/or current performance, and change the reference coefficient table for determining the hyperplane equation according to the current state and/or current performance. Because the hyperplane, which is a reference for identifying the type of cleaning surface, is appropriately changed according to the change in the performance of the vacuum cleaner 1*a*, a difficulty in which the cleaning surface is incorrectly identified may not occur.

Figure 5:
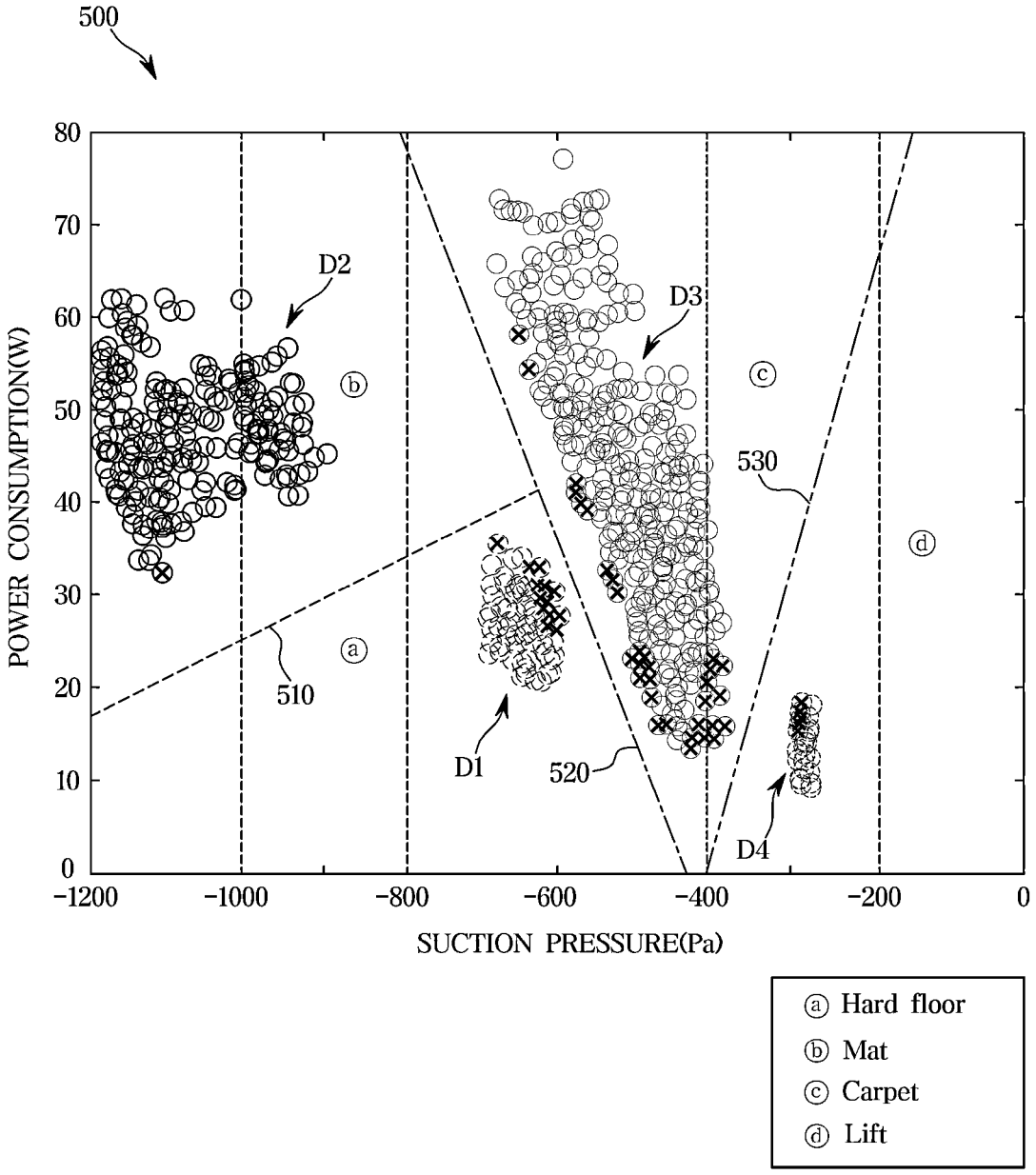
FIG. 5 illustrates an example of classifying a type of a cleaning surface using a hyperplane in a two-dimensional coordinate system according to an embodiment of the disclosure.

FIG. 5 illustrates an example of classifying a type of a cleaning surface using a hyperplane in a two-dimensional coordinate system.

Referring to a graph 500 of FIG. 5, the controller 300 may determine a plurality of linear equations related to a plurality of hyperplanes by using a reference coefficient table selected from among the plurality of coefficient tables stored in the memory 320. For example, a first hyperplane 510, a second hyperplane 520 and a third hyperplane 530 may be determined. The first hyperplane 510, the second hyperplane 520, and the third hyperplane 530 may be determined by different linear equations. By the first hyperplane 510, the second hyperplane 520, and the third hyperplane 530, the coordinate planes may be divided into a first region ⓐ, a second region ⓑ, a third region ⓒ, and a fourth region ⓓ.

The controller 300 of the vacuum cleaner 1*a* may identify where the suction pressure values and the load values of the brush motor 150, which are obtained during the cleaning operation, are located on the coordinate plane, thereby identifying the type of cleaning surface currently being cleaned. When the variable of the x-axis is the suction pressure and the variable of the y-axis is the load (e.g., power consumption) of the brush motor 150, a position of the plurality of points corresponding to the suction pressure values and the load values of the brush motor 150 may be determined on the 2D coordinate plane.

The suction pressure and the load (e.g., power consumption) of the brush motor 150 may vary according to the type of cleaning surface being in contact with the suction head 15. For example, the largest absolute value of the suction pressure may be measured when the cleaning surface is a mat, and the smallest absolute value of the suction pressure may be measured when the vacuum cleaner 1*a* is separated from the cleaning surface, that is, the lift state. The absolute value of the suction pressure may decrease in the sequence of the mat, the hard floor, and the carpet, but the change of the suction pressure is not limited to the exemplified example.

The load (e.g., power consumption) of the brush motor 150 may increase as the resistance applied to the brush 151 by the cleaning surface increases. For example, the load of the brush motor 150 may be measured as a large value on long-haired carpets. The load of the brush motor 150 may decrease in the sequence of the carpet, the mat, and the hard floor, but the change in load is not limited to the exemplified example. In the lift state in which the suction head 15 is separated from the cleaning surface, the output of the brush motor 150 and the output of the suction motor 160 may adjusted to the smallest, and thus the suction pressure and the load of the brush motor 150 may be measured as the smallest.

Each of the regions divided by the plurality of hyperplanes may correspond to different cleaning surfaces. For example, the first region ⓐ may correspond to a hard floor, the second region ⓑ may correspond to a mat, the third region ⓒ may correspond to a carpet, and the fourth region ⓓ may correspond to the lift state.

The suction pressure data and the load data of the brush motor 150 obtained during the cleaning operation of the vacuum cleaner 1*a* may be referred to as 'driving data'. When a first driving data D1 located in the first region ⓐ is obtained, the controller 300 may identify the cleaning surface as a hard floor. When a second driving data D2 located in the second region ⓑ is obtained, the controller 300 may identify the cleaning surface as a mat. When a third driving data D3 located in the third region ⓒ is obtained, the controller 300 may identify the cleaning surface as a carpet. When a fourth driving data D4 located in the fourth region ⓓ is obtained, the controller 300 may identify the cleaning surface as the lift state.

In other words, the type of cleaning surface may be identified differently depending on whether a point corresponding to the driving data is located above or below the first hyperplane 510, above or below the second hyperplane 520, or above or below the third hyperplane 530. When the suction pressure corresponding to a x-value and the load of the brush motor 150 corresponding to a y-value are input into the equation of the hyperplane determined as a linear equation (e.g., $a*x+b*y+c=0$) in the 2D-coordinate system, a positive value or negative value may be obtained. When a positive value is obtained, it may be determined that a point corresponding to the driving data is located above the hyperplane. When a negative value is obtained, it may be determined that a point corresponding to the driving data is located below the hyperplane.

Figure 6:
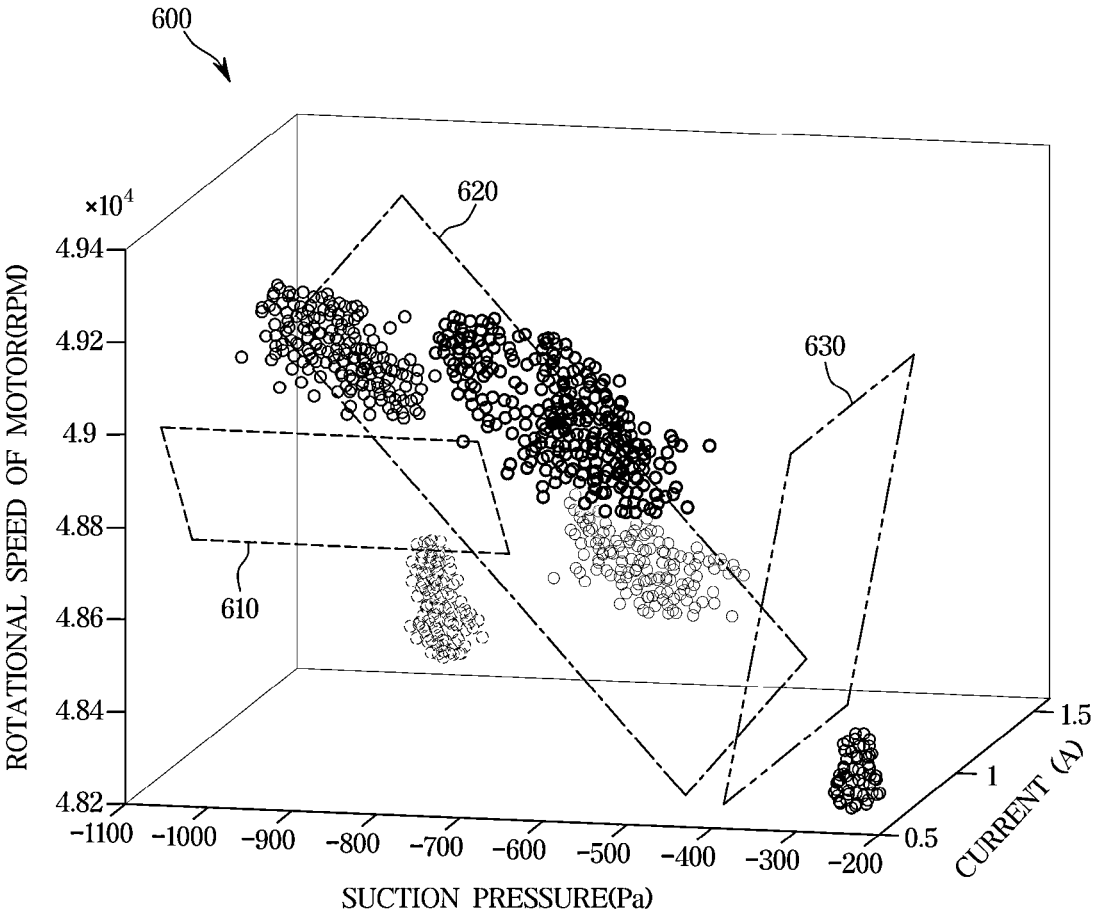
FIG. 6 illustrates an example of classifying a type of a cleaning surface using a hyperplane in a three-dimensional coordinate system according to an embodiment of the disclosure.

FIG. 6 illustrates an example of classifying a type of a cleaning surface using a hyperplane in a three-dimensional coordinate system.

Referring to a graph 600 of FIG. 6, the controller 300 may determine a plurality of plane equations related to a plurality of hyperplanes by using a reference coefficient table selected from among the plurality of coefficient tables stored in the memory 320. For example, a fourth hyperplane 610, a fifth hyperplane 620 and a sixth hyperplane 630 may be determined. The fourth hyperplane 610, the fifth hyperplane 620 and the sixth hyperplane 630 may be determined by different plane equations.

When the variable of the x-axis is the suction pressure, the variable of the y-axis is the load of the brush motor 150, and the variable of the z-axis is the rotational speed of the brush motor 150 in the 3D coordinate system, a position of the plurality of points corresponding to the suction pressure values, the load values of the brush motor 150, and the rotational speed values of the brush motor 150 obtained during the cleaning operation of the vacuum cleaner 1*a* may be determined in the 3D coordinate space.

As mentioned above, the suction pressure and the load of the brush motor 150 may vary according to the type of cleaning surface being in contact with the suction head 15. Further, the rotational speed of the brush motor 150 may also vary according to the type of cleaning surface being in contact with the suction head 15. The rotational speed of the brush motor 150 may decrease as a resistance applied to the brush 151 by the cleaning surface increases. For example, the rotational speed of the brush motor 150 may decrease in the sequence of a mat, a hard floor, and a carpet, but is not limited to the illustrated example. In the lift state in which the suction head 15 is separated from the cleaning surface, the output of the brush motor 150 and the output of the suction motor 160 may be adjusted to the smallest, and thus the rotational speed of the brush motor 150 may be measured as the smallest.

The suction pressure data, the load data of the brush motor 150, and the rotational speed data of the brush motor 150 obtained during the cleaning operation of the vacuum cleaner 1*a* may be referred to as 'driving data'. The type of cleaning surface may be identified differently depending on whether a point corresponding to the driving data is located above or below the fourth hyperplane 610, above or below the fifth hyperplane 620, or above or below the sixth hyperplane 630.

When the suction pressure corresponding to a x-value, the load of the brush motor 150 corresponding to a y-value, and the rotational speed of the brush motor 150 corresponding to a z-value are input into the equation of the hyperplane determined as a plane equation (e.g., $d*x+e*y+f*z+g=0$) in the 3D-coordinate system, a positive value or negative value may be obtained. When a positive value is obtained, it may be determined that a point corresponding to the driving data is located above the hyperplane. When a negative value is obtained, it may be determined that a point corresponding to the driving data is located below the hyperplane. That is, the type of the cleaning surface may be determined based on the position of a point corresponding to the driving data in the coordinate space. Because a factor for classifying the cleaning surface is added to the 3D coordinate system, the classification of the cleaning surface may be performed more accurately than in the 2D coordinate system.

FIG. 7 is a table illustrating an example in which at least one of an output of a suction motor and an output of a brush motor is adjusted according to the type of cleaning surface.

Referring to a table 700 of FIG. 7, the controller 300 of the vacuum cleaner 1*a* may adjust at least one of the output of the suction motor 160 and the output of the brush motor 150 based on the identified type of the cleaning surface. For example, when the cleaning surface is identified as a hard floor, the output of the suction motor 160 may be adjusted to a reference output. When the cleaning surface is identified as a carpet, the output of the suction motor 160 may be adjusted to be greater than the reference output. When the cleaning surface is identified as a mat, the output of the suction motor 160 may be adjusted to be less than the reference output. When the suction head 15 is identified as being in the air, that is, in the lift state, the output of the suction motor 160 may be minimized.

In addition, the output of the brush motor 150 may be also adjusted to the reference output on the hard floor, to be greater than the reference output on the carpet, to be less than the reference output on the mat, and adjusted to the minimum in the lift state.

The adjusting of the output of the brush motor 150 and the adjusting of the output of the suction motor 160 are not limited thereto. The output of the brush motor 150 and the output of the suction motor 160 may be adjusted differently. Additionally, the brush motor 150 and the suction motor 160 may be controlled to operate with different outputs in the illustrated cleaning surface.

Figure 8:
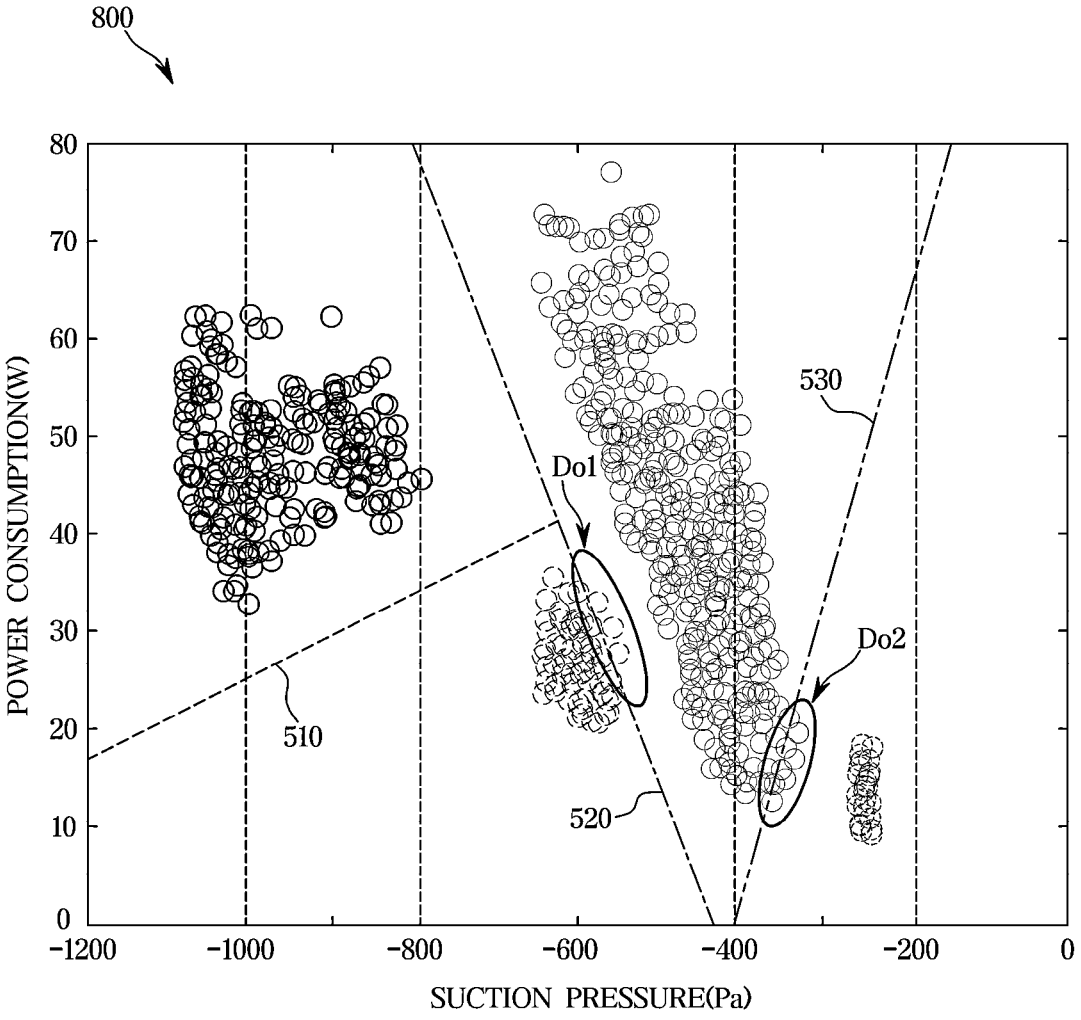
FIG. 8 is a graph illustrating an example in which the type of cleaning surface is incorrectly identified due to the deterioration of the vacuum cleaner according to an embodiment of the disclosure.

FIG. 8 is a graph illustrating an example in which the type of cleaning surface is incorrectly identified due to the deterioration of the vacuum cleaner.

As mentioned above, the suction pressure, the load of the brush motor 150, and/or the rotational speed of the brush motor 150 for the same cleaning surface may change as the vacuum cleaner 1*a* deteriorates. For example, when the brush 151 is worn out, friction with the cleaning surface decreases, and thus the power consumption of the brush motor 150 may decrease and the rotational speed of the brush motor 150 may increase. When the performance of the suction motor 160 is degraded, it may cause a reduction in the suction pressure. When this change is not reflected, the type of cleaning surface may be incorrectly identified.

Referring to a graph 800 of FIG. 8, points corresponding to suction pressure values and load values of the brush motor 150 obtained while a new vacuum cleaner 1*a* cleans a hard floor may be located between the hyperplane 510 and the second hyperplane 520. However, as the vacuum cleaner 1*a* deteriorates, points located above the second hyperplane 520 may be obtained while cleaning a hard floor. Suction pressure values and load values of the brush motor 150 corresponding to some points located above the second hyperplane 520 may be referred to as a first interference data Do1. Due to the first interference data Do1, the controller 300 may temporarily incorrectly identify the cleaning surface as a carpet even though the cleaning surface being actually cleaned by the vacuum cleaner 1*a* is the hard floor.

In addition, points corresponding to suction pressure values and load values of the brush motor 150 obtained while the vacuum cleaner 1*a* cleans a carpet may be located between the second hyperplane 520 and the third hyperplane 530. However, as the vacuum cleaner 1*a* deteriorates, some points located under the third hyperplane 530 may be obtained while cleaning a carpet. Suction pressure values and load values of the brush motor 150 corresponding to points located under the third hyperplane 530 may be referred to as a second interference data Do2. Due to the second interference data Do2, the controller 300 may temporarily incorrectly identify the vacuum cleaner 1*a* as being in the lift state even though the cleaning surface being actually cleaned by the vacuum cleaner 1*a* is a carpet. In this case, it may cause a misunderstanding of product failure to consumers, and may adversely affect the cleaning performance and battery performance.

To relieve these difficulties, the disclosed vacuum cleaner 1*a* may easily change the hyperplane by selecting the coefficient table, which corresponds to the current state of the vacuum cleaner 1*a*, from among the plurality of coefficient tables stored in the memory 320.

FIGS. 9 and 10 illustrate a plurality of coefficient tables related to a hyperplane equation in the two-dimensional coordinate system. FIG. 11 illustrates a coefficient table related to a hyperplane equation in the three-dimensional coordinate system.

The memory 320 of the vacuum cleaner 1*a* may store the plurality of coefficient tables including coefficients of a hyperplane equation used to identify the type of cleaning surface. Each of the plurality of coefficient tables includes coefficients related to a hyperplane equation of the 2D coordinate system or a hyperplane equation of the 3D coordinate system.

The coefficient table related to the hyperplane in the 2D coordinate system may include coefficients of each of a plurality of linear equations having the load of the brush motor 150 and the suction pressure of the suction port 15*a* as variables. The coefficient table related to the hyperplane in the 3D coordinate system may include coefficients of each of a plurality of plane equations having the load of the brush motor 150, the suction pressure of the suction port 15*a*, and the rotational speed of the brush motor 150 as variables.

The controller 300 of the vacuum cleaner 1*a* may select a coefficient table corresponding to the current state of the vacuum cleaner 1*a* from among the plurality of coefficient tables, as a reference coefficient table. The controller 300 may drive the suction motor 160 and the brush motor 150 in the first state (i.e., the lift state) in which the suction head 15 of the vacuum cleaner 1*a* is separated from the cleaning surface. According to the driving of the suction motor 160 and the brush motor 150, the first suction pressure of the suction port 15*a* and the first load of the brush motor 150 may be determined, and the first rotational speed of the brush motor 150 may also be determined.

The controller 300 may determine a coefficient table of the 2D coordinate system corresponding to the first suction pressure and the first load obtained in the first state, as the reference coefficient table. Further, the controller 300 may determine a coefficient table of the 3D coordinate system corresponding to the first suction pressure, the first load, and the first rotational speed obtained in the first state, as the reference coefficient table.

Referring to FIG. 9, when the first load value of the brush motor 150 is L1 [W] and the first suction pressure value is P1 [Pa], which are obtained in the first state (i.e., the lift state), a first coefficient table 900 including values equal to the load value and the first suction pressure value may be selected as the reference coefficient table. Further, when the first load value of the brush motor 150 is closest to L1 [W] and/or the first suction pressure value is closest to P1 [Pa], which are obtained in the first state, the first coefficient table 900 may be selected as the reference coefficient table.

When the first coefficient table 900 is selected, a first linear equation of the first hyperplane 510 described in FIG. 5 may be determined as $a1*x+b1*y+c1=0$, a second linear equation of the second hyperplane 520 may be determined as $a2*x+b2*y+c2=0$, and a third linear equation of the third hyperplane 530 may be determined as $a3*x+b3*y+c3=0$. Numerical values of each coefficient shown in the first coefficient table 900 are not limited thereto.

Referring to FIG. 10, when the first load value of the brush motor 150 is L2 [W] and the first suction pressure value is P2 [Pa], which are obtained in the first state (i.e., the lift state), a second coefficient table 1000 including values equal to the load value and the first suction pressure value may be selected as the reference coefficient table. Further, when the first load value of the brush motor 150 is closest to L2 [W] and/or the first suction pressure value is closest to P2 [Pa], which are obtained in the first state, the second coefficient table 1000 may be selected as the reference coefficient table.

When the second coefficient table 1000 is selected, a first equation of the first hyperplane 510 described in FIG. 5 may be determined as a4*x+b4*y+c4=0, a second equation of the second hyperplane 520 may be determined as a5*x+b5*y+c5=0, and a third equation of the third hyperplane 530 may be determined as a6*x+b6*y+c6=0. Numerical values of each coefficient shown in the second coefficient table 1000 are not limited thereto.

However, a coefficient table matching the first load and the first suction pressure obtained in the first state may not be present. In this case, the controller 300 may select a plurality of candidate tables including values within a predetermined error range of each of the first suction pressure and the first load, from among the plurality of coefficient tables, and determine a reference coefficient table by linearly interpolating the plurality of candidate tables.

For example, the first load value of the brush motor 150 obtained in the first state may be Lm, which is an intermediate value between L1 and L2, and the first suction pressure value may be Pm, which is an intermediate value between P1 and P2. The first load value Lm may be greater than the load L1 of the first coefficient table 900 and less than the load L2 of the second coefficient table 1000. The first suction pressure Pm may be greater than the suction pressure P1 of the first coefficient table 900 and less than the suction pressure P2 of the second coefficient table 1000. In addition, each of L1 and L2 may be a value within an error range of the first load value Lm, and each of P1 and P2 may be a value within an error range of the first suction pressure value Pm.

The controller 300 may select the first coefficient table 900 and the second coefficient table 1000 as candidate tables, and determine coefficients of a hyperplane equation by linearly interpolating the first coefficient table 900 and the second coefficient table 1000. For example, linear interpolation may be calculating an average value of coefficient values of the first coefficient table 900 and coefficient values of the second coefficient table 1000. The linear interpolation method is not limited to thereto, and various linear interpolation methods may be used.

Referring to FIG. 11, when the first load value of the brush motor 150 is L3 [W], the first suction pressure value is P3 [Pa], and the first rotational speed value of the brush motor 150 is V1 [RPM] which are obtained in the first state (lift state), a third coefficient table 1100 including values equal to the first load value, the first suction pressure value, and the first rotational speed value may be selected as a reference coefficient table. When the first load value of the brush motor 150 is closest to L3 [W], the first suction pressure value is closest to P3 [Pa], and/or the first rotational speed value is closest to V1 [RPM] which are obtained in the first state, the third coefficient table 1100 may be selected as a reference coefficient table.

When the third coefficient table 1100 is selected, a fourth equation of the fourth hyperplane 610 described in FIG. 6 may be determined as d1*x+e1*y+f1*z+g1=0, a fifth equation of the fifth hyperplane 620 may be determined as d2*x+e2*y+f2*z+g2=0, and a sixth equation of the sixth hyperplane 630 may be determined as d3*x+e3*y+f3*z+g3=0.

In addition, when a coefficient table matching the first load, the first suction pressure, and the first rotational speed obtained in the first state is not present, the controller 300 may select a plurality of candidate tables including values within a predetermined error range of each of the first load, the first suction pressure, and the first rotational speed, from among the plurality of coefficient tables, and determine a reference coefficient table by linearly interpolating the plurality of candidate tables.

Coefficient tables are not limited to those illustrated in FIGS. 9 to 11. A plurality of coefficient tables corresponding to various suction pressure values, various load values, and various rotational speed values may be stored in the memory 320.

Figure 12:
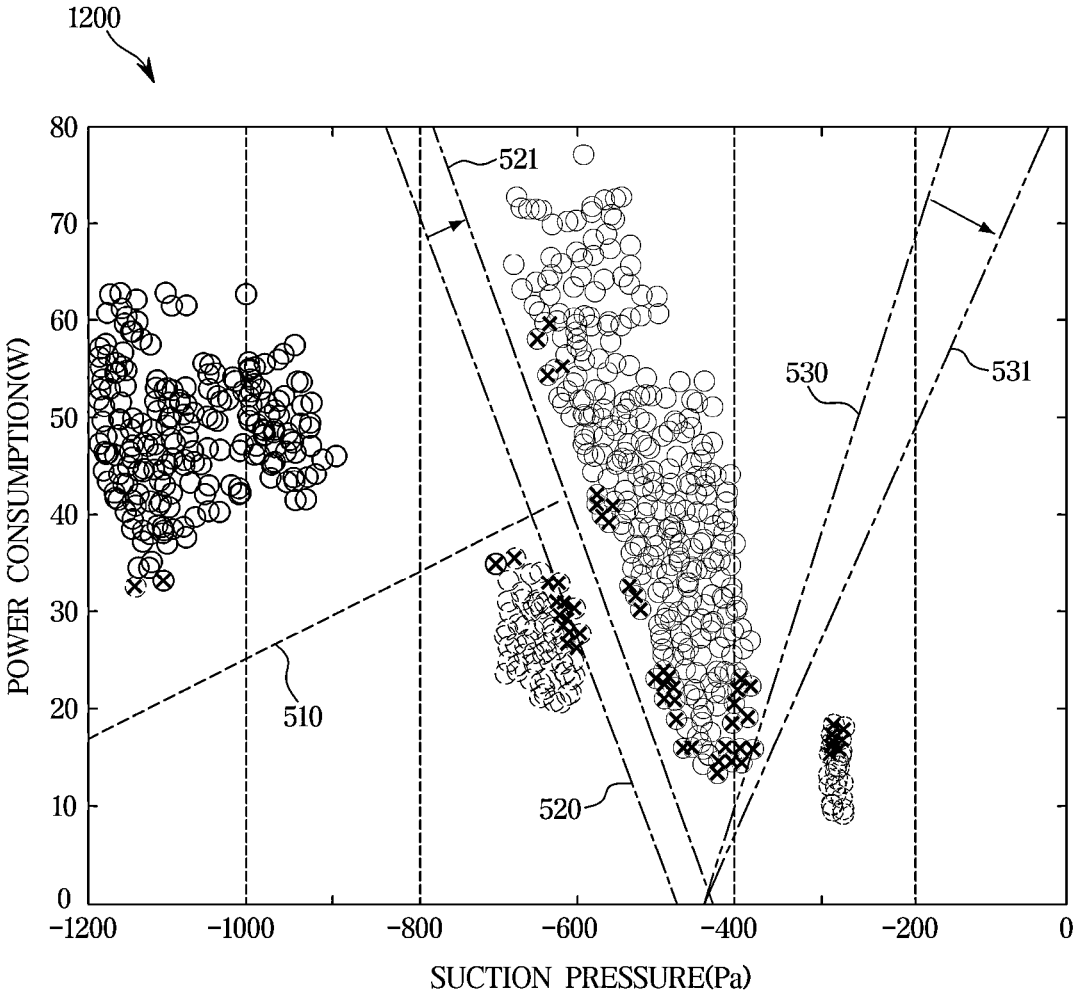
FIG. 12 is a graph illustrating an example in which a hyperplane is changed according to a change in a reference coefficient table according to an embodiment of the disclosure.

FIG. 12 is a graph illustrating an example in which a hyperplane is changed according to a change in a reference coefficient table.

Referring to a graph 1200 of FIG. 12, the controller 300 of the vacuum cleaner 1*a* may change the hyperplane by changing the reference coefficient table for determining the hyperplane. By changing the reference coefficient table, the existing second hyperplane 520 may be changed to a new second hyperplane 521, and the existing third hyperplane 530 may be changed to a new third hyperplane 531. The first hyperplane 510 may be maintained as it is. Through the change of the hyperplane, even when the suction pressure and the load of the brush motor 150 for the same cleaning surface are changed, the type of cleaning surface may be correctly identified.

Figure 13:
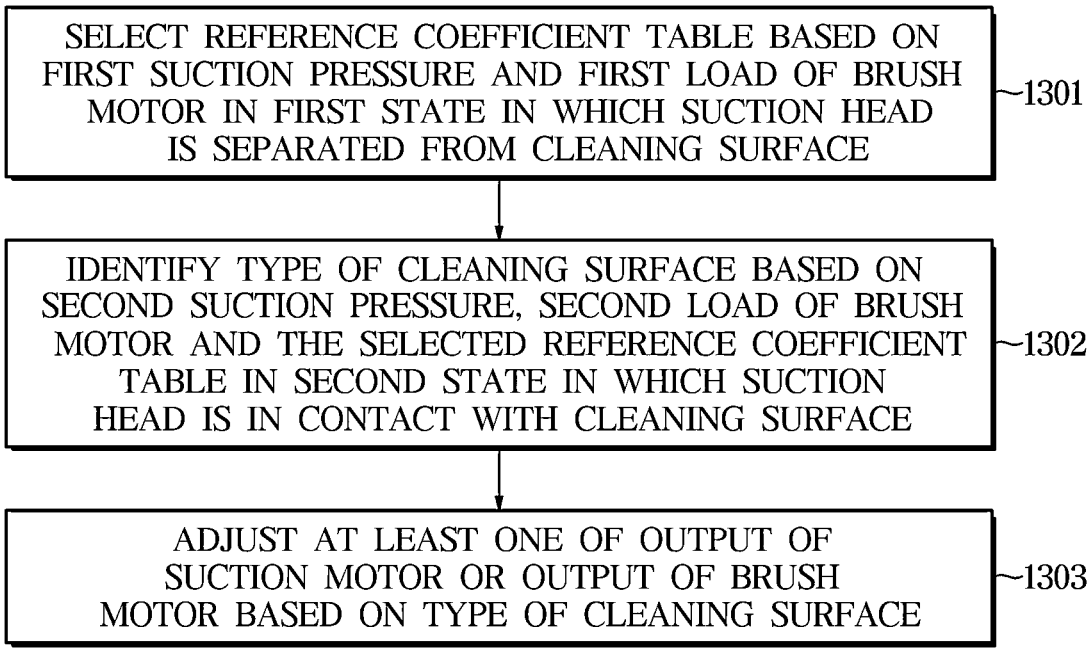
FIG. 13 is a flowchart illustrating a control method of the cleaning device according to an embodiment of the disclosure.
Figure 14:
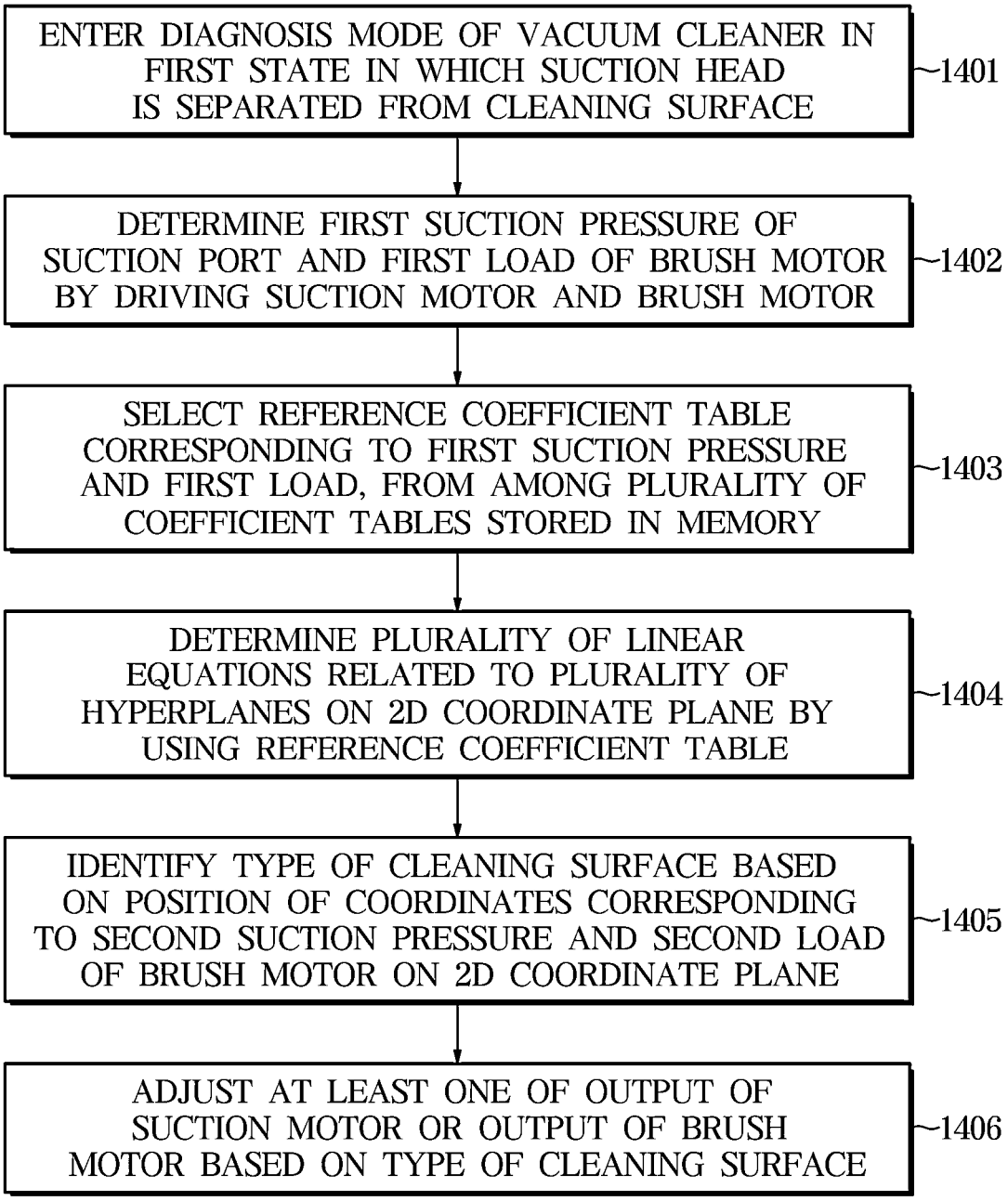
FIG. 14 is a flowchart illustrating the control method of the cleaning device described in FIG. 13 in more detail according to an embodiment of the disclosure.

FIG. 13 is a flowchart illustrating a control method of the cleaning device according to an embodiment. FIG. 14 is a flowchart illustrating the control method of the cleaning device described in FIG. 13 in more detail.

Referring to FIG. 13, the controller 300 of the vacuum cleaner 1*a* may select the reference coefficient table based on the first suction pressure of the suction port 15*a* and the first load of the brush motor 150 which are determined in the first state in which the suction head 15 is separated from the cleaning surface (1301). Thereafter, the controller 300 may drive the brush motor 150 and the suction motor 160 in the second state in which the suction head 15 is in contact with the cleaning surface, and identify the type of cleaning surface based on the second suction pressure of the suction port 15*a*, the second load of the brush motor 150 and the selected reference coefficient table (1302). The controller 300 may adjust the output of the suction motor 160 and/or the output of the brush motor 150 based on the identified type of cleaning surface (1303).

Referring to FIG. 14, the controller 300 of the vacuum cleaner 1*a* may enter the diagnosis mode in the first state in which the suction head 15 is separated from the cleaning surface (1401). In the first state, the controller 300 may enter the diagnosis mode when the controller 300 obtains a user input for entering the diagnosis mode through the user interface 180 or when the controller 300 identifies the coupling of the vacuum cleaner 1*a* and the docking station 1*b*.

The controller 300 may determine the first suction pressure of the suction port 15*a* and the first load of the brush motor 150 by driving the suction motor 160 and the brush motor 150 in the first state (1402). The controller 300 may select a reference coefficient table corresponding to the first suction pressure and the first load, from among the plurality of coefficient tables stored in the memory 320 (1403). The controller 300 may determine the plurality of linear equations related to the plurality of hyperplanes on the 2D coordinate plane by using the selected reference coefficient table (1404).

Thereafter, the controller 300 may determine the second suction pressure of the suction port 15*a* and the second load of the brush motor 150 by driving the suction motor 160 and the brush motor 150 in the second state in which the suction head 15 is in contact with the cleaning surface. The controller 300 may identify the type of cleaning surface based on the position of the coordinates corresponding to the second suction pressure and the second load, on the 2D coordinate plane (1405). The controller 300 may adjust the output of the suction motor 160 and/or the output of the brush motor 150 based on the identified type of cleaning surface (1406).

Figure 15:
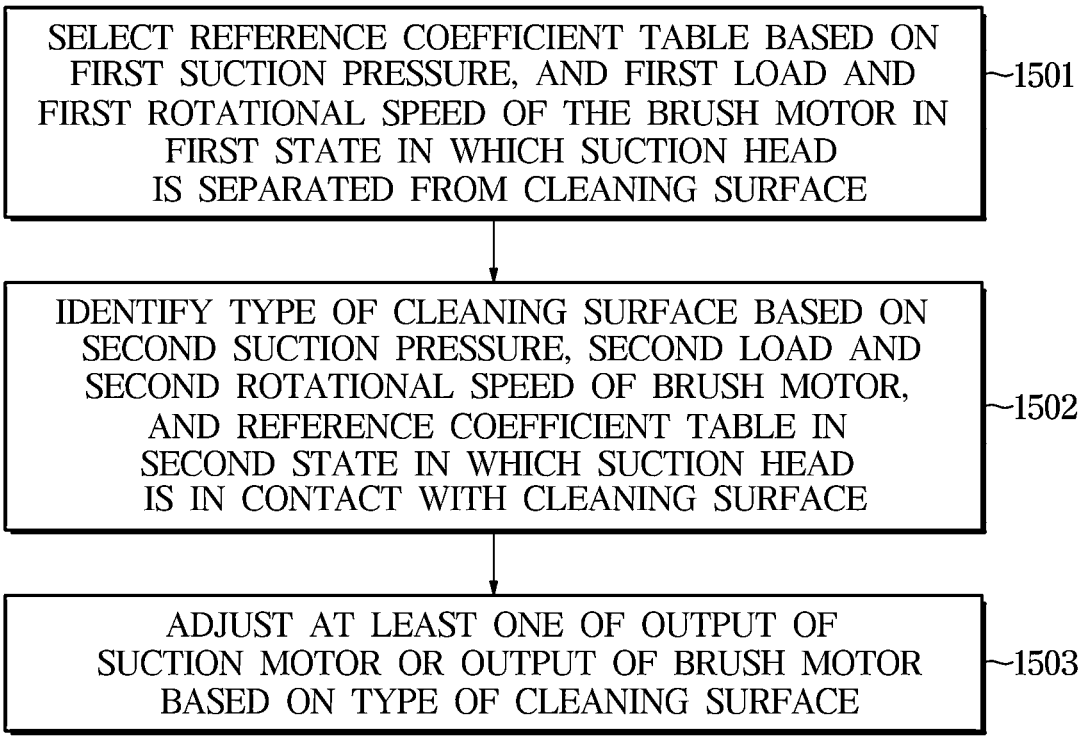
FIG. 15 is a flowchart illustrating a control method of a cleaning device according to an additional embodiment of the disclosure extended from FIG. 13.
Figure 16:
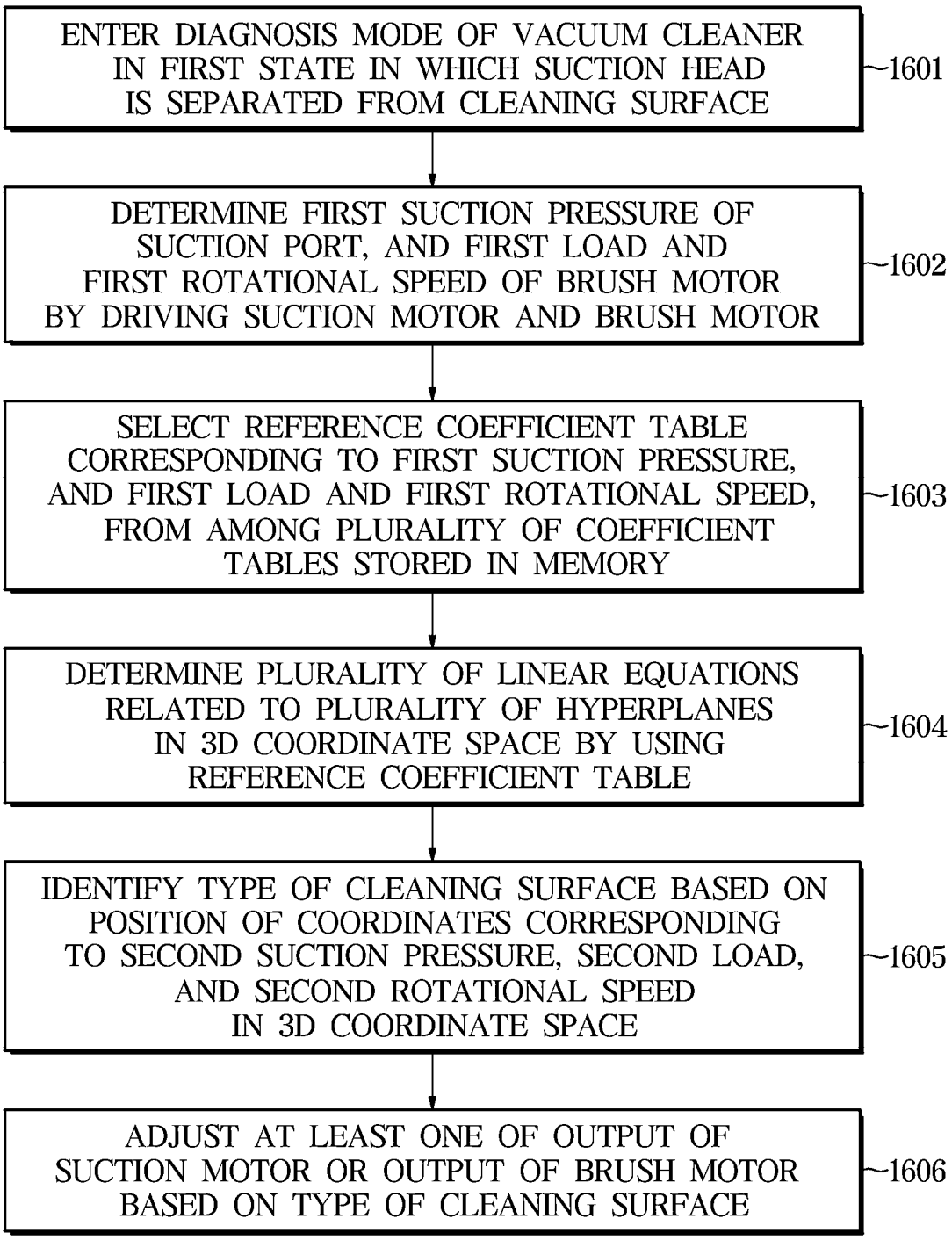
FIG. 16 is a flowchart illustrating the control method of the cleaning device described in FIG. 15 in more detail according to an embodiment of the disclosure.

FIG. 15 is a flowchart illustrating a control method of a cleaning device according to an additional embodiment extended from FIG. 13. FIG. 16 is a flowchart illustrating the control method of the cleaning device described in FIG. 15 in more detail.

Referring to FIG. 15, the controller 300 of the vacuum cleaner 1*a* may select the reference coefficient table based on the first suction pressure of the suction port 15*a*, the first load of the brush motor 150, and the first rotational speed of the brush motor 150 which are determined in the first state in which the suction head 15 is separated from the cleaning surface (1501). Thereafter, the controller 300 may drive the brush motor 150 and the suction motor 160 in the second state in which the suction head 15 is in contact with the cleaning surface, and identify the type of cleaning surface based on the second suction pressure of the suction port 15*a*, the second load of the brush motor 150, the second rotational speed of the brush motor 150 and the selected reference coefficient table (1502). The controller 300 may adjust the output of the suction motor 160 and/or the output of the brush motor 150 based on the identified type of cleaning surface (1503).

Referring to FIG. 16, the controller 300 of the vacuum cleaner 1*a* may enter the diagnosis mode in the first state in which the suction head 15 is separated from the cleaning surface (1601). In the first state, the controller 300 may enter the diagnosis mode when the controller 300 obtains a user input for entering the diagnosis mode through the user interface 180 or when the controller 300 identifies the coupling of the vacuum cleaner 1*a* and the docking station 1*b*.

The controller 300 may determine the first suction pressure of the suction port 15*a*, the first load of the brush motor 150, and the first rotational speed of the brush motor 150 by driving the suction motor 160 and the brush motor 150 in the first state (1602). The controller 300 may select a reference coefficient table corresponding to the first suction pressure, the first load and the first rotational speed, from among the plurality of coefficient tables stored in the memory 320 (1603). The controller 300 may determine the plurality of plane equations related to the plurality of hyperplanes in the 3D coordinate space by using the selected reference coefficient table (1604).

Thereafter, the controller 300 may determine the second suction pressure of the suction port 15*a*, the second load of the brush motor 150, and the second rotational speed of the brush motor 150 by driving the suction motor 160 and the brush motor 150 in the second state in which the suction head 15 is in contact with the cleaning surface. The controller 300 may identify the type of cleaning surface based on the position of the coordinates corresponding to the second suction pressure, the second load, and the second rotational speed, in the 3D coordinate space (1605). The controller 300 may adjust the output of the suction motor 160 and/or the output of the brush motor 150 based on the identified type of cleaning surface (1606).

As is apparent from the above description, a cleaning device and a control method thereof may change a reference for classifying a type of a cleaning surface in consideration of deterioration of a vacuum cleaner. Accordingly, it is possible to prevent to incorrectly identify the type of the cleaning surface due to the deterioration of the vacuum cleaner.

Further, a cleaning device and a control method thereof may adjust an output of a suction motor and a brush motor according to a type of a cleaning surface and prevent to incorrectly identify the cleaning surface. It is possible to improve user convenience, and to prevent reduction in cleaning performance and battery performance.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaning device comprising:

a body;

a suction motor arranged in the body and configured to generate a suction force;

a suction head including a suction port through which foreign substances are sucked by the suction force;

a brush configured to rotate inside the suction head;

a brush motor configured to rotate the brush;

a pressure sensor configured to detect a suction pressure at the suction port;

a memory configured to store a plurality of coefficient tables including coefficients of a hyperplane equation for determining a type of surface to be cleaned; and a controller configured to control the suction motor, the brush motor, the pressure sensor, and the memory, wherein the controller is configured to:

in a first state in which the suction head is separated from the surface to be cleaned, select from the memory a reference coefficient table corresponding to a first detected suction pressure at the suction port and a first load of the brush motor, in a second state in which the suction head is in contact with the surface to be cleaned, identify a type of the surface to be cleaned based on a second detected suction pressure at the suction port, a second load of the brush motor, and the selected reference coefficient table, and adjust at least one of an output of the suction motor and an output of the brush motor based on the identified type of the surface to be cleaned.

2. The cleaning device of claim 1, wherein the controller is configured to:

determine, based on the selected reference coefficient table, a plurality of linear equations related to a plurality of hyperplanes on a two-dimensional coordinate plane, and identify the type of the surface to be cleaned based on a position of coordinates corresponding to the second detected suction pressure and the second load of the brush motor on the two-dimensional coordinate plane.

3. The cleaning device of claim 1, wherein the controller is configured to:

select from the memory the reference coefficient table further corresponding to a first rotational speed of the brush motor obtained in the first state, and identify the type of the surface to be cleaned further based on a second rotational speed of the brush motor obtained in the second state.

4. The cleaning device of claim 3, wherein the controller is configured to:

determine, based on the selected reference coefficient table, a plurality of plane equations related to a plurality of hyperplanes in a three-dimensional coordinate space, and identify the type of the surface to be cleaned based on a position of coordinates corresponding to the second detected suction pressure, the second load of the brush motor, and the second rotational speed of the brush motor in the three-dimensional coordinate space.

5. The cleaning device of claim 1, further comprising:

a user interface configured to obtain a user input, wherein the controller is configured to drive the suction motor and the brush motor in response to obtaining the user input for entering a diagnosis mode in the first state to determine the first detected suction pressure and the first load of the brush motor.

6. The cleaning device of claim 1, further comprising:

a docking station configured to be coupled to the body, wherein the controller is configured to drive the suction motor and the brush motor based on the body being coupled to the docking station and entering a diagnosis mode to determine the first detected suction pressure and the first load of the brush motor.

7. The cleaning device of claim 1, wherein the controller is configured to:

select, as the reference coefficient table, a coefficient table including values equal to the first detected suction pressure and the first load of the brush motor among the plurality of coefficient tables.

8. The cleaning device of claim 1, wherein the controller is configured to:

select, as the reference coefficient table, a coefficient table including values closest to the first detected suction pressure and the first load of the brush motor among the plurality of coefficient tables.

9. The cleaning device of claim 1, wherein the controller is configured to:

select a plurality of candidate tables including values within a predetermined error range of each of the first detected suction pressure and the first load of the brush motor, from among the plurality of coefficient tables, and determine the reference coefficient table by linearly interpolating the plurality of candidate tables.

10. The cleaning device of claim 1, wherein the controller is configured to:

determine the first load of the brush motor or the second load of the brush motor based on a current applied to the brush motor or power consumption of the brush motor.

11. A method of controlling a cleaning device, the method comprising:

driving a suction motor and a brush motor of the cleaning device in a first state in which a suction head is separated from a surface to be cleaned;

determining a first suction pressure at a suction port in the suction head and a first load of the brush motor in the first state;

selecting a reference coefficient table corresponding to the first suction pressure and the first load of the brush motor, from among a plurality of coefficient tables related to a hyperplane equation stored in a memory;

driving the suction motor and the brush motor in a second state in which the suction head is in contact with the surface to be cleaned;

determining a second suction pressure of the suction port and a second load of the brush motor in the second state;

identifying a type of the surface to be cleaned based on the second suction pressure at the suction port, the second load of the brush motor, and the reference coefficient table; and adjusting at least one of an output of the suction motor and an output of the brush motor based on the identified type of the surface to be cleaned.

12. The control method of claim 11, wherein the identifying the type of the surface to be cleaned includes;

determining, based on the selected reference coefficient table, a plurality of linear equations related to a plurality of hyperplanes on a two-dimensional coordinate plane, and identifying the type of the surface to be cleaned based on a position of coordinates corresponding to the second suction pressure and the second load of the brush motor on the two-dimensional coordinate plane.

13. The control method of claim 11, wherein the selecting the reference coefficient table is further based on a first rotational speed of the brush motor obtained in the first state; and the identifying the type of the surface to be cleaned is further based on a second rotational speed of the brush motor obtained in the second state.

14. The control method of claim 13, wherein the identifying the type of the surface to be cleaned includes:

determining, based on the selected reference coefficient table, a plurality of plane equations related to a plurality of hyperplanes in a three-dimensional coordinate space, and identifying the type of the surface to be cleaned based on a position of coordinates corresponding to the second suction pressure, the second load of the brush motor, and the second rotational speed of the brush motor in the three-dimensional coordinate space.

15. The control method of claim 11, wherein the driving of the suction motor and the brush motor in the first state is performed in response to obtaining a user input, which is for entering a diagnosis mode, through a user interface.

16. The control method of claim 11, wherein the driving of the suction motor and the brush motor in the first state is performed based on a body of the cleaning device being coupled to a docking station and entering a diagnosis mode.

17. The control method of claim 11, wherein the reference coefficient table is a coefficient table including values equal to the first suction pressure and the first load of the brush motor among the plurality of coefficient tables.

18. The control method of claim 11, wherein the reference coefficient table is a coefficient table including values closest to the first suction pressure and the first load of the brush motor among the plurality of coefficient table.

19. The control method of claim 11, wherein the selecting the reference coefficient table includes:

selecting a plurality of candidate tables including values within a predetermined error range of each of the first suction pressure and the first load of the brush motor, from among the plurality of coefficient tables, and determining the reference coefficient table by linearly interpolating the plurality of candidate tables.

20. The control method of claim 11, wherein the first load or the second load of the brush motor is determined based on a current applied to the brush motor or power consumption of the brush motor.

* * * * *